US012697001B2

(12) United States Patent
Mason

(10) Patent No.: US 12,697,001 B2
(45) Date of Patent: Aug. 4, 2026

(54) WEARABLE CLEANING EXFOLIATOR

(71) Applicant: MOXXY PRODUCTS, LLC, Van Nuys, CA (US)

(72) Inventor: Alison Mason, Chicago, IL (US)

(73) Assignee: MOXXY PRODUCTS, LLC, Van Nuys (CA)

( * ) Notice: Subject to any disclaimer, the term of this patent is extended or adjusted under 35 U.S.C. 154(b) by 537 days.

(21) Appl. No.: 18/205,953

(22) Filed: Jun. 5, 2023

(65) Prior Publication Data

US 2023/0389757 A1 Dec. 7, 2023

Related U.S. Application Data

(60) Provisional application No. 63/349,887, filed on Jun. 7, 2022.

(51) Int. Cl.

| | |
|---|---|
| ***A47L 13/19*** | (2006.01) |
| ***A46B 5/04*** | (2006.01) |
| ***A46B 15/00*** | (2006.01) |
| ***A47K 7/02*** | (2006.01) |
| *A47L 13/282* | (2006.01) |

(52) U.S. Cl.

CPC ..... *A47K 7/02* (2013.01); *A46B 5/04* (2013.01); *A46B 15/0085* (2013.01); *A46B 15/0089* (2013.01); *A47L 13/19* (2013.01); *A46B 2200/1006* (2013.01); *A47L 13/282* (2013.01)

(58) Field of Classification Search

CPC ..... A47K 7/02; A46B 5/04; A46B 15/0085; A46B 15/0089; A46B 2200/1006; A47L 13/19; A47L 13/282

See application file for complete search history.

(56) References Cited

U.S. PATENT DOCUMENTS

| | | | | | |
|---|---|---|---|---|---|
| 660,886 | A | * | 10/1900 | Bryan | A47L 13/19 401/118 |
| 1,209,763 | A | * | 12/1916 | Rosengren | A47L 13/19 601/138 |
| 2,738,533 | A | * | 3/1956 | Peterson | A47L 13/282 36/15 |
| 3,362,775 | A | * | 1/1968 | Muecke | A47L 13/282 401/6 |
| 3,460,182 | A | * | 8/1969 | Grande, Jr. | A47L 13/282 15/227 |
| 4,893,955 | A | * | 1/1990 | Zielinski | A46B 5/04 401/7 |
| 4,907,297 | A | | 3/1990 | Gallucci | |
| 5,173,985 | A | * | 12/1992 | Palmer | A47L 13/282 451/523 |
| 5,956,770 | A | | 9/1999 | Dennis | |
| 6,038,726 | A | * | 3/2000 | Kelly | A47L 13/282 36/59 R |

(Continued)

OTHER PUBLICATIONS

International Searching Authority/US, International Search Report and Written Opinion issued for PCT/US2023/024469 on Oct. 6, 2023.

*Primary Examiner* — Ryan J. Walters
(74) *Attorney, Agent, or Firm* — Quarles & Brady LLP

(57) ABSTRACT

A wearable cleaning device may be physically worn by a user along her hand or foot. A cleaning device includes a body, an abrasive pad, and a cleaning strip. The abrasive pads and the cleaning strips are coupled to the body of the cleaning device.

16 Claims, 23 Drawing Sheets

(56) References Cited

U.S. PATENT DOCUMENTS 6,122,793 A * 9/2000 Pao ..... A47L 13/20 36/7.1 R
6,145,156 A * 11/2000 Pullara, Jr. ..... A47L 13/18 220/571
6,446,300 B1 * 9/2002 Sleezer ..... A47L 13/282 36/7.1 R
7,845,043 B2 * 12/2010 McLogan ..... A47L 13/282 36/8.1
7,945,983 B1 * 5/2011 Neu ..... A47L 13/282 15/118
8,424,148 B1 * 4/2013 Neu ..... A47L 13/282 15/118
8,898,848 B1 12/2014 Stevens
11,026,554 B2 * 6/2021 Peters, Jr. ..... A46B 11/0072
2001/0047558 A1 * 12/2001 Ahern ..... A47L 13/282 15/118
2006/0032075 A1 2/2006 Vossoughi et al.
2006/0101667 A1 * 5/2006 Kane ..... A43B 3/106 36/7.1 R
2006/0265828 A1 * 11/2006 Mallatt ..... A47L 13/282 401/6
2008/0078046 A1 * 4/2008 Reed ..... A41D 19/01 2/16
2008/0201879 A1 * 8/2008 Heidemeyer ..... H05K 3/361 15/104.92
2008/0229533 A1 * 9/2008 Skibicki ..... A47L 13/18 15/227
2010/0175215 A1 * 7/2010 Reed ..... A41D 19/015 15/227
2011/0088190 A1 * 4/2011 Clark ..... A47K 7/02 15/227
2014/0359915 A1 12/2014 Oh et al.
2016/0143508 A1 * 5/2016 Mc Grath ..... A47L 25/005 15/104.002

* cited by examiner

WEARABLE CLEANING EXFOLIATOR

CROSS REFERENCE TO RELATED APPLICATIONS

This application claims the benefit of and priority to U.S. Provisional Application No. 63/349,887, filed on Jun. 7, 2022, the contents of which is incorporated by reference herein in its entirety.

BACKGROUND

1. Field of the Disclosure

The present disclosure relates to a wearable multi-purpose cleaning exfoliator that provides for manual exfoliation and cleaning while bathing or showering.

2. Description of the Background of the Disclosure

Exfoliation is a process of removing the dead skin cells from the outermost layer of one's skin. The process of exfoliation may involve a physical exfoliation and/or a chemical exfoliation. The process of exfoliation exploits the benefit of a process known as cell renewal. Cell renewal is a natural process whereby new skin cells are generated, pushing away the dead skin cells to the outermost surface of the skin. The process of physical exfoliation involves the use of tools such as exfoliating brushes, exfoliating sponges, and exfoliating scrubs. The process of chemical exfoliation involves a chemical exfoliator. The chemical exfoliator includes hydroxy acids such as glycolic acids, lactic acids, tartaric acids, citric acids, salicylic acids or the like. The removal of dead skin cells may provide aesthetic benefits such as the brightening of skin's appearance, the improving of skin conditions, and the removal of dry and/or dull skin. Conventionally, exfoliation takes place while cleaning your body, such as during or after a shower or during or after a bath.

Cleaning of a bathroom, more specifically a bathtub or a walk-in shower is a common practice in a household; however, such cleaning involves arduous scrubbing of surfaces that can be difficult to reach. Without regular cleaning of the bathtub or shower, mold or mildew may form between or along grout located between tiles that are subject to moisture from a water source for the bathtub or shower. Additionally, a plethora of germs and bacteria can accumulate along the walls of the bathtub. The mold, mildew, bacteria, and germs that are present along the bathtub can even cause sickness or diseases, such as pulmonary or respiratory diseases. While tools such as scrubbers, brushes, and/or chemical solutions are used to clean the surface of the bathtub and the tiles adjacent to the bathtub, these solutions do not account for the difficulty associated with hard-to-reach surfaces.

SUMMARY

The present disclosure includes a wearable cleaning device that simultaneously enables the exfoliation of a user's skin and the cleaning of various surfaces along and around a bathtub or shower. The wearable cleaning device may be physically worn by a user along her hand or foot.

In the current disclosure, a hand wearable cleaning device can be a cleaning glove. The cleaning glove can include a body, an abrasive pad, and a cleaning stip. The body of the cleaning glove includes a dorsal surface, a palmar surface, and an opening. The dorsal surface and the palmar surface are integral with one another and define an interior volume and the opening is configured to receive the hand within the interior volume. The abrasive pads are coupled with the palmar surface of the cleaning glove. The cleaning strips extend from an inner edge of the hand to an outer fourchette of the cleaning glove along a little finger.

In another aspect of the current disclosure, the hand wearable cleaning device can be a cleaning mitten. A shell of the cleaning device includes a dorsal surface, a palmar surface, and an opening. The dorsal surface and the palmar surface are integral with one another and define an interior volume and the opening is configured to receive the hand within the interior volume. The shell defines a first compartment and a second compartment, and he first compartment is configured to enclose a plurality of fingers and the second compartment is configured to enclose the thumb. The dorsal surface includes a first material and the palmar surface includes a second material, and the first material is a lighter exfoliating material than the second material.

In another aspect of the present disclosure, a foot wearable cleaning device includes a body that includes a sole. The sole cavity is disposed along a bottom surface of the sole and the sole cavity includes an opening. The opening defines an abrasive pocket with an inner abrasive layer and an outer abrasive layer. An abrasive pad is coupled to the bottom surface of the sole. The abrasive pocket encloses a cleaner and the abrasive pocket is not coupled along at least one side of the foot wearable cleaning device to form the opening.

DETAILED DESCRIPTION OF THE DRAWINGS

Figure 1:
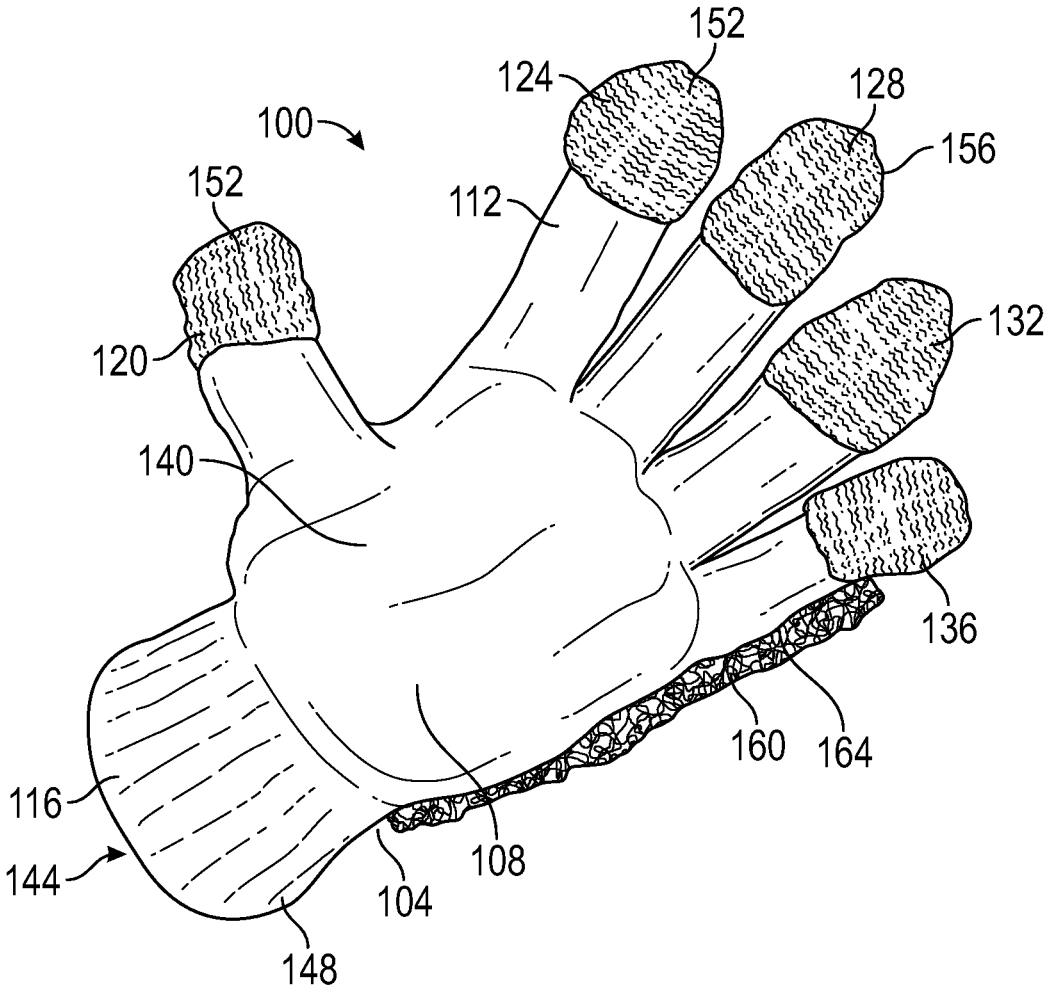
FIG. 1 is a perspective view of a wearable cleaning exfoliator that includes a plurality of abrasive pads and a cleaning strip.

The following discussion and accompanying figures disclose various embodiments or configuration of a wearable cleaning exfoliator, specifically a hand wearable cleaning device or a foot wearable cleaning device. For instance, the hand wearable cleaning device can be a cleaning glove or a cleaning mitten, and the foot wearable cleaning device can be a cleaning sock or an article of footwear (e.g., sandals, shoes). In some illustrated embodiments, the hand wearable cleaning device can be represented by a left side of the hand wearable cleaning device, the left of the hand wearable cleaning device and the right side of the hand wearable cleaning device being substantially the same. However, in some embodiments, there may be differences between the left side of the hand wearable cleaning device and the right side of the hand wearable cleaning device other than the configuration. For example, in some embodiments, the left side of the hand wearable cleaning device may include one or more additional elements that the right side of the hand wearable cleaning device does not include, or vice versa. Additionally, the embodiments of the foot wearable cleaning device disclosed herein can be represented by a left cleaning sock, the left cleaning sock and the right cleaning sock being substantially the same. However, in some embodiments, there may be differences between the left side of the foot wearable cleaning device and the right side of the foot wearable cleaning device other than the configuration. For example, in some embodiments, the left side of the foot wearable cleaning device may include one or more additional elements that the right side of the foot wearable cleaning device does not include, or vice versa.

The following discussion and accompanying figures regarding a skeletal anatomy of a hand and a foot is represented by a right hand and a right foot. Although the figures are represented by the right hand and the right foot, a left hand and a left foot are substantially the same. The left hand and the left foot are mirror images of the right hand and the right foot about a sagittal plane.

In general, different tools and methods are applied to exfoliate one's skin. Most commonly, the method of exfoliation may be categorized by a physical/mechanical exfoliation method or a chemical exfoliation method. The chemical exfoliation method involves a chemical exfoliator, which are commonly present in a form of an acid that removes the dead skin cells located on the outermost surface of one's skin. The physical and/or the mechanical exfoliation utilizes a physical exfoliator, such as, but not limited to, an exfoliating brush, an exfoliating sponge, an exfoliating glove, an exfoliating scrub, or the like. The operating principle behind the physical exfoliator is friction. The physical exfoliators work against the outermost layer of one's skin by means of friction and actively remove dead skin cells via rubbing and sloughing. The process of exfoliation provides aesthetic benefits such as unclogged pores, promotion of skin clarity and brightening, and the like.

The process of cleaning a bathroom, specifically the cleaning of a damp region such as a bathtub, a walk-in bathtub, and/or a sink requires different chemical agents and different physical tools. On outermost surfaces of bathtubs and walk-in showers, a plethora of germs and bacteria can accumulate along the walls of the tub, and mold and mildew may form along bathtub grout or crevices between tiles adjacent to the bathtub. Chemical agents, such as sodium hypochlorite, commonly known as bleach, may be used jointly with the physical tools such as a scrubber, a brush, and/or a sponge to clean such surfaces. However, some chemical agents must be used with caution due to the potency of the chemicals therein. Additionally, different physical tools for cleaning the aforementioned surfaces have various shortcomings. For example, a narrow brush may be an adequate tool for cleaning bathroom grout but may not be ideal for large surfaces, and a large scrubber may be adequate for large surfaces but may be cumbersome for crevices and the edges of the bathtub. Thus, different types of physical tools may be needed to fully clean and disinfect the bathtub. Conventionally, a thorough cleaning session is needed to sanitize the bathtub, but a smaller cleaning session may prevent the growth of germs and bacteria being accumulated.

The process of physical exfoliation takes place during or after a shower or a bath. The process of physical exfoliation utilizes physical exfoliators, which leaves behind a plurality of dead skin cell debris in the form of a string, a roll, or the like. Therefore, the smaller cleaning session to remove the plurality of dead skin cell debris may be required after the process of exfoliation. With respect to surface cleaning in a bathroom, a smaller cleaning session may include the removal of soap scums, the removal of the pink slime, the swiping of the stagnant water, and/or the removal of the small patches of mold or mildew that are located between or along the bathroom grout. The smaller cleaning session of the bathtub or the walk-in shower may require the use of different tools and the different tools may overcrowd the bathtub and the nearby surrounding, which may limit the movement of the individual and may be a cause of unwanted fall hazard.

To overcome these limitations or otherwise provide improved functionality, the present disclosure provides for a wearable cleaning exfoliator that has the functional benefits of the physical exfoliator and the benefits of a multipurpose cleaning device. The wearable cleaning exfoliator of the present disclosure may be worn over a hand, similar to a glove, or a foot, similar to a sock, of a user. Even in times of different cleaning machines, cleaning by hand has been proven to provide various benefits such as, but not limited to, the cost-effectiveness, the ability to sense and precisely clean the desired location, and the ability to reach in places where other devices or machines may find hard to reach.

Referring now to FIG. 1, a cleaning glove 100 is shown in accordance with the present disclosure. The cleaning glove 100 includes a periphery 104 that is defined by a body 108 in the form of a human hand, a plurality of finger extensions 112, and a wrist 116. The plurality of finger extensions 112 includes a thumb 120, an index finger 124, a middle finger 128, a ring finger 132, and a little finger 136. The plurality of finger extensions 112 extends outwardly from a palm 140 of the body 108. The cleaning glove 100 is formed from an eco-friendly exfoliating material that encases the hand of a user. The cleaning glove 100 includes an opening 144 that is located at the end of a cuff 148. The cuff 148 is formed integrally with the palm 140 of the cleaning glove 100 and the cuff 148 extends partially toward an elbow (not shown) of an arm (not shown). In some embodiments, the cuff 148 comprises a stretchable material such as, but not limited to polyamide fiber, and may include a hanging loop. The cuff 148 may be a knit wrist cuff to provide firm grip around the wrist, holding the cleaning glove 100 in place and keeping debris from getting in. The cleaning glove 100 enclosing the plurality of finger extensions 112 is formed integrally with the palm 140 of the cleaning glove 100 and an abrasive pad 152 is defined along a fingertip 156 of the plurality of finger extensions 112. The cleaning glove 100 may include a cleaning strip 160 that extends from the wrist 116 and along an outer fourchette 164 of the little finger 136.

Figure 2:
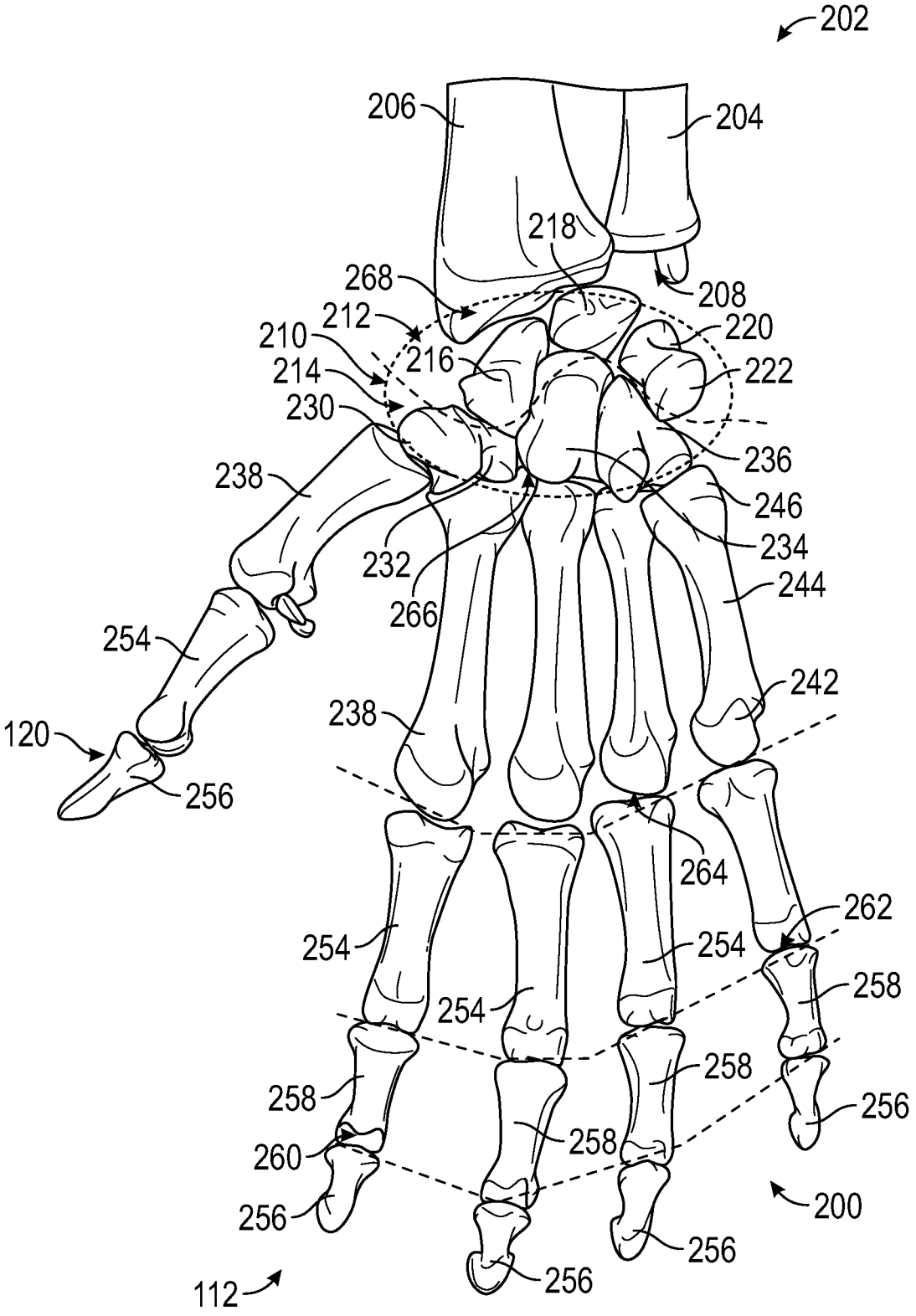
FIG. 2 is a top anterior view of a user's skeletal right hand structure.

FIGS. 2-5 depict a skeletal anatomy of a right hand 200 including 27 bones, which is provided to highlight the various aspects of the cleaning glove 100 with respect to locations along the right hand 200. Referring specifically to FIG. 2, an anterior view or a palmer view 202 of the right hand 200 includes 27 bones, an ulna 204 and a radius 206. The ulna 204 and the radius 206 are adjacent to a base 208 of the right hand 200 which contains 8 bones, each known as a carpal bone 210. The carpal bones 210 are arranged into two rows, a proximal row 212 and a distal row 214. The proximal row 212 of the carpal bones 210 includes a scaphoid 216, a lunate 218, a triquetrum 220, and a pisiform 222. The distal row 214 of the carpal bones 210 includes a trapezium 230, a trapezoid 232, a capitate 234 and a hamate 236. The carpal bones 210 are adjacent to a metacarpal bone 238. The 5 metacarpal bones 238 defines the palm 140 and the metacarpal bones 238 includes a head portion 242, a body portion 244 and a base portion 246.

Among the 27 bones, 14 bones make the plurality of finger extensions 112 and the thumb 120. The 14 bones making up the plurality of finger extensions 112 and the thumb 120 are known as a phalange. The thumb 120 includes a proximal phalange 254 and a distal phalange 256, whereas the remaining plurality of finger extensions 112 include the proximal phalange 254, an intermediate phalange 258, and the distal phalange 256. The distal phalange 256 and the intermediate phalange 258 are adjoined by a distal interphalangeal joint 260. The proximal phalange 254 and the intermediate phalanges are adjoined by the proximal interphalangeal joints 262. The proximal phalange 254 and the head portion 242 of the metacarpal bone 238 are adjoined by a metacarpophalangeal joint 264. The base portion 246 of the metacarpal bone 238 and the distal row 228 of the carpal bone 210 is adjoined by a carpometacarpal joint 266. The proximal row 212 of the carpal bone 210 and the radius 206 are adjoined by a radiocarpal joint 268.

Figure 3:
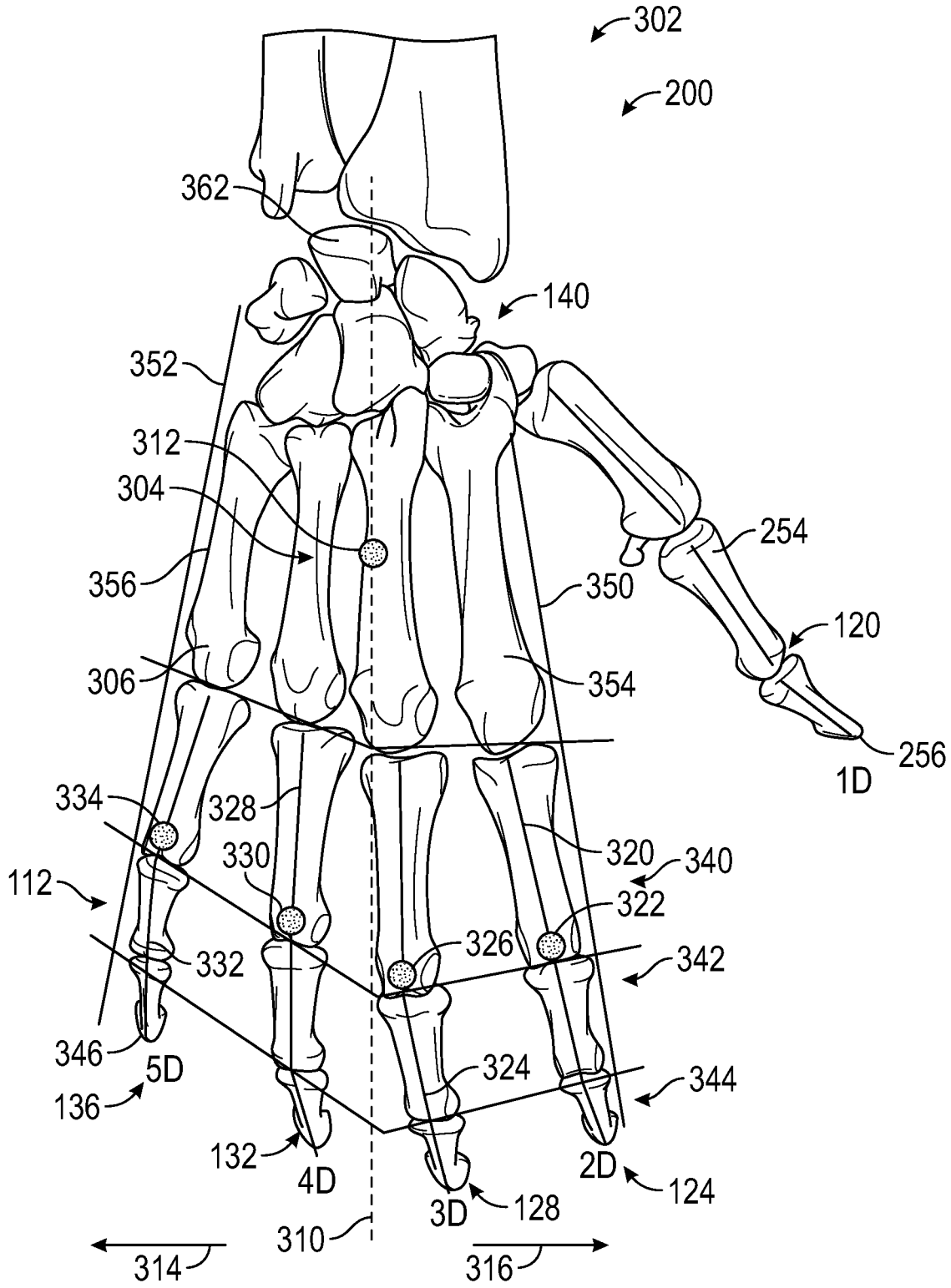
FIG. 3 is a top posterior view of the user's skeletal right hand structure.

FIG. 3 depicts a posterior view or a dorsal view 302 of the right hand 200 shown in FIG. 2. The dorsal view 302 includes the thumb 120, the index finger 124, the middle finger 128, the ring finger 132, and the little finger 136. The thumb 120 includes a distal phalange 256 and a proximal phalange 254 and may be named as a first digit 1D. The index finger 124, the middle finger 128, the ring finger 132 and the little finger 136 include a distal phalange 256, an intermediate phalange 258, and a proximal phalange 254. The index finger 124 may be named as a second digit 2D, the middle finger 128 may be named as a third digit 3D, the ring finger 132 may be named as a fourth digit 4D, and the little finger 136 may be named as a fifth digit 5D. The opposite side of the palm 140 is called a dorsal surface 304 that comprises the metacarpal bone 238 that is connected to the plurality of finger extensions 112 and the thumb 120. The dorsal view 302 of the right hand 200 includes a knuckle 306 that is formed between the head portion 242 of the metacarpal bone 238 and the proximal phalange 254. The base portion 246 of the metacarpal bone 238 are connected to the distal row 214 of the carpal bone 210.

The right hand 200 may be divided by a primary sagittal plane 310 that runs laterally through a centroid 312 of the right hand 200 defining a right side 314 of the right hand 200 and a left side 316 of the right hand 200. The index finger 124 includes a second sagittal plane 320 that extends through a second centroid 322 of the second digit 2D of the phalanges 252. The middle finger 128 includes a third sagittal plane 324 that extends through a third centroid 326 of the third digit 3D of the phalanges 252. The ring finger 132 includes a fourth sagittal plane 328 that extends through a fourth centroid 330 of the fourth digit 4D of the phalanges 252. The little finger 136 includes a fifth sagittal plane 332 that extends through a fifth centroid 334 of the fifth digit 5D of the phalanges 252. The phalanges are divided into a proximal zone 340, an intermediate zone 342, and a distal zone 344. The proximal zone 340 is closest to the palm 140 of the right hand 200 formed by the metacarpal bones 238. The distal zone 344 is the outermost zone which includes a fingertip 346 which comprises a nail plate (not shown) positioned immediately above a nail bed (not shown) and a pad (not shown) opposite of the nail plate (not shown). The intermediate zone 342 is placed between the proximal zone 340 and the distal zone 344. Based on the location from the primary sagittal plane 310, a medial surface 350 and a lateral surface 352 of a body part may be determined. The medial surface 350 is the surface that is closer toward the primary sagittal plane 310, and the lateral surface 352 is the surface farthest away from the primary sagittal plane 310. The index finger 124 includes a medial surface 350 which is defined as an outer edge 354 of the right hand 200. The little finger 136 includes a lateral surface 352 which is defined as an inner edge 356 of the right hand 200.

Figure 4:
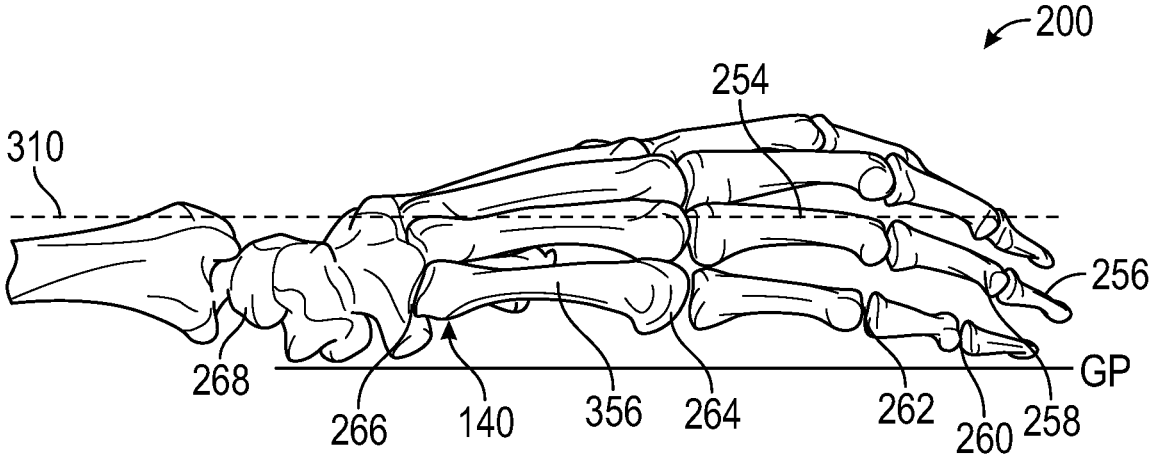
FIG. 4 is a right lateral view of the user's skeletal right hand structure.

FIG. 4 depicts the inner edge 356 of the right hand 200 resting above a ground plane GP. The distal interphalangeal joint 260, the proximal interphalangeal joints 262, the metacarpophalangeal joint 264 the carpometacarpal joint 266, and the radiocarpal joint 268 of the right hand 200 are shown. The distal interphalangeal joint 260 has one degree of freedom which allows the flexion and extension of the of the distal phalange 256 about the distal interphalangeal joint 260. The motion of flexion curls inward toward the palm 140 and the motion of extension extends outwardly away from the palm 140. The proximal interphalangeal joint 262 also has one degree of freedom, which allows flexion and extension of the intermediate phalange 258 about the proximal interphalangeal joint 262. The metacarpophalangeal joint 264 has two degrees of freedom which allows flexion, extension, radial abduction and radial adduction of the proximal phalange 254 about the metacarpophalangeal joint 264. The radial abduction is a motion of extending the proximal phalange 254 outwardly away from the primary sagittal plane 310 along a radial direction, and the radial adduction is a motion of contracting the proximal phalanges 254 closer to the primary sagittal plane 310 along the radial direction.

Figure 5:
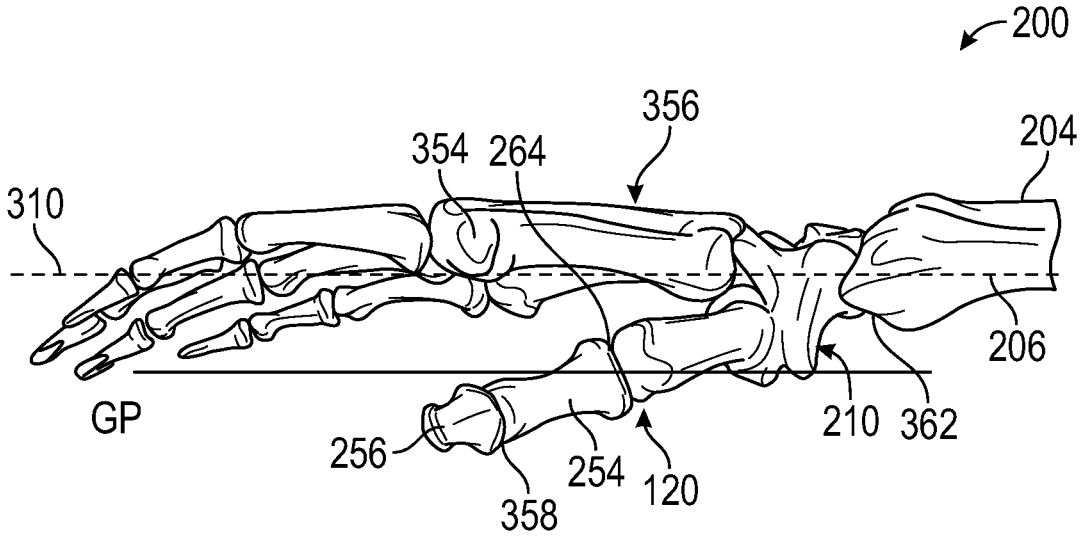
FIG. 5 is a left medial view of the user's skeletal right hand structure.

FIG. 5 depicts the outer edge 354 of the right hand 200 resting above the ground plane GP. The thumb 120 includes one distal phalange 256 and one proximal phalange 254. The distal phalange 256 of the thumb 120 and the proximal phalange 254 of the thumb 120 form an interphalangeal joint 358, which has one degree of freedom allowing flexion and extension. The metacarpophalangeal joint 264 provides two degrees of freedom enabling a palmar adduction and a palmar abduction. The palmar adduction is a motion of the thumb 120 moving closer to the outer edge 354 of the right hand 200. The palmar abduction is a motion of the thumb 120 moving away from the outer edge 354 of the right hand 200. Additionally, the thumb 120 includes one more degrees of freedom which allows retro-position and opposition of the thumb 120. The opposition is a motion of the thumb 120 moving toward the inner edge 356 of the right hand 200 and the retro-position is a motion of the thumb 120 moving away from the inner edge 356 of the right hand 200.

The carpal bones 210 define a wrist joint 362 and the carpal bones 210 are joined with the ulna 204 and the radius 206 providing three degrees of freedom. The wrist joints 362 are capable of flexion, extension, abduction, adduction, supination and pronation. The motion of supination is a clockwise rotational motion about the primary sagittal plane 310, and the motion of pronation is a counterclockwise rotational motion about the primary sagittal plane 310.

Figure 6:
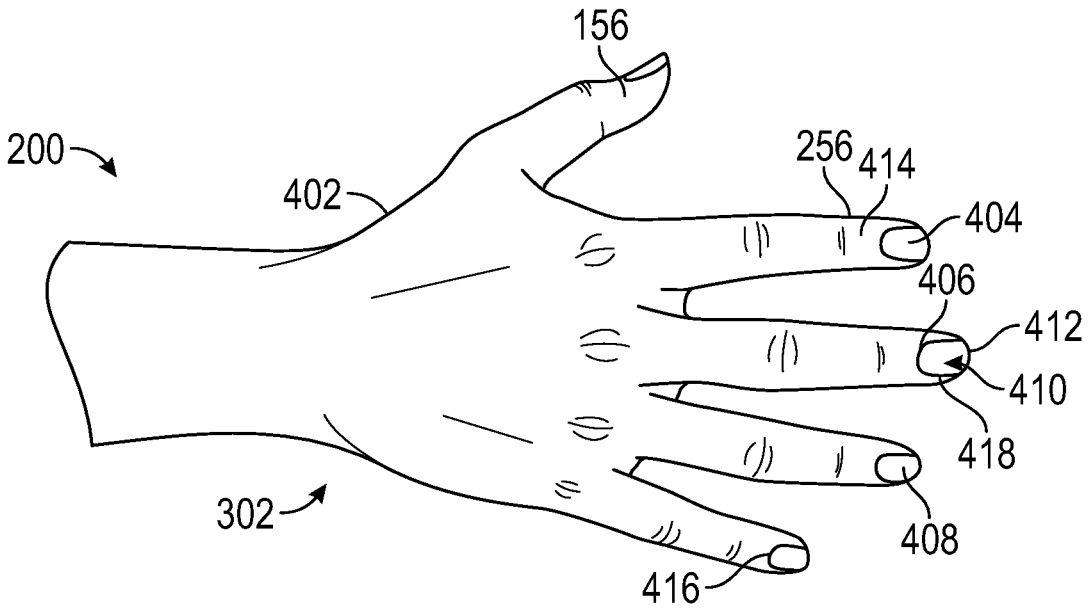
FIG. 6 is a top view of a dorsal side of a user's right hand.
Figure 7:
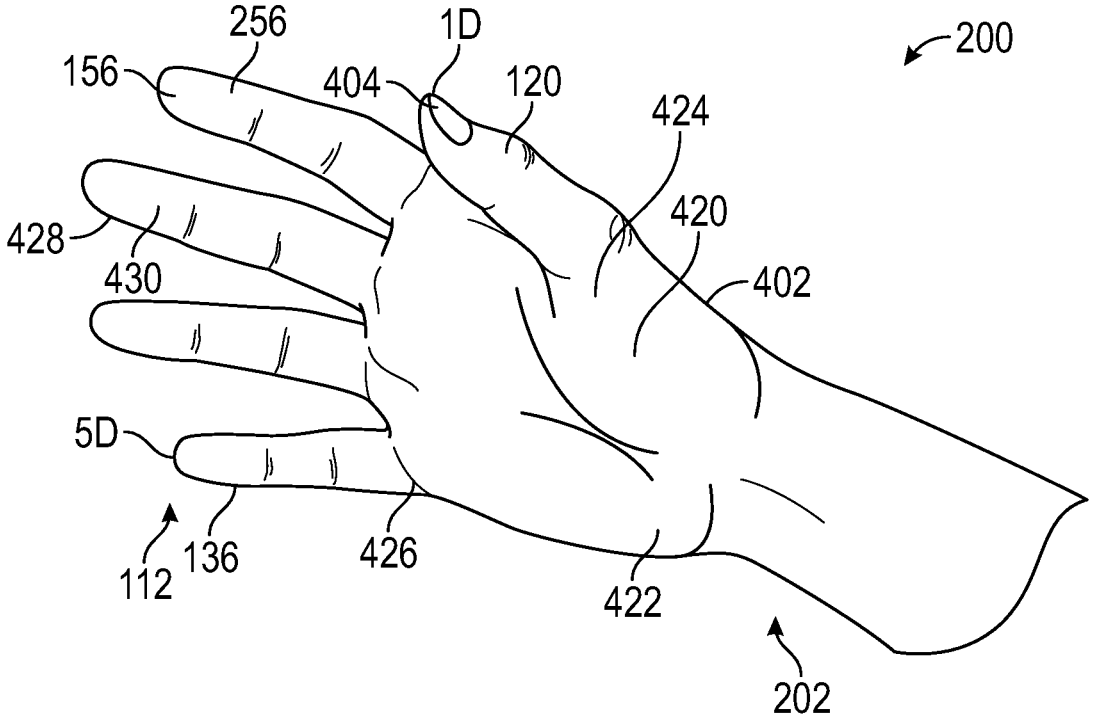
FIG. 7 is a bottom, perspective view of a palmar side of the user's right hand.

Referring now to FIGS. 6 and 7, the skeletal anatomy of the right hand 200 is enclosed by an epidermis 402, which is an outermost skin layer of a human body. Specifically referring to FIG. 6, a dorsal view 302 of the right hand 200 includes a visual representation of the fingertip 156 defined adjacent to the distal phalange 256. The fingertip 156 includes a nail plate 404, a nail fold 406, a lunula 408, a nail bed 410, and a free distal edge 412. The nail plate 404 is made up of keratin protein formed by amino acids that covers the nail bed 410. The nail bed 410 is a soft skin layer beneath the nail plate 404. The periphery of the nail plate 404 is surrounded by a proximal nail fold 414 at a base 416 of the nail plate 404, and a lateral nail fold 418 that extends from the proximal nail fold 414 along each side of the nail plate 404. The free distal edge 412 extends outwardly as the nail plate 404 grows outwards. The lunula 408 is a half-moon shape figure beneath the nail plate 404.

Referring now to FIG. 7, the palmer view 202 of the right hand 200 includes a visual representation of a thenar 420 and a hypothenar 422. The thenar 420 is a mound defined adjacent to the first digit 1D base 424 of the thumb 120. The thenar 420 is formed by three muscles which control the movements of the thumb 120. The hypothenar 422 is a mound defined adjacent to a fifth digit base 426 of the little finger 136. The hypothenar 422 is formed by four muscles which contract to manifest motion through the little finger 136. The fingertip 156 is defined by the distal phalange 256 that includes a concentric circular pad 428 that is disposed opposite of the nail plate 404. The concentric circular pad 428 includes a plurality of friction ridges 430 formed on the epidermis 402 of the plurality of finger extensions 112. During the motion of scrubbing and exfoliating, a majority of the pressure is concentrated along the thenar 420, the hypothenar 422, and the concentric circular pads 428 of the right hand 200.

FIGS. 8-12 depict the cleaning glove 100 shown in FIG. 1 of the present disclosure. As a physical exfoliator, or a manual tool that works to slough away dead skin cells, the cleaning glove 100 has exfoliation properties and includes a rough texture. However, physical exfoliators with rough texture may cause skin irritation, redness, and skin inflammation caused by a breakdown of a skin barrier function and may also lead to over-exfoliation. Therefore, roughness of the exfoliator may vary based on a sensitivity of the user's skin.

Figure 8:
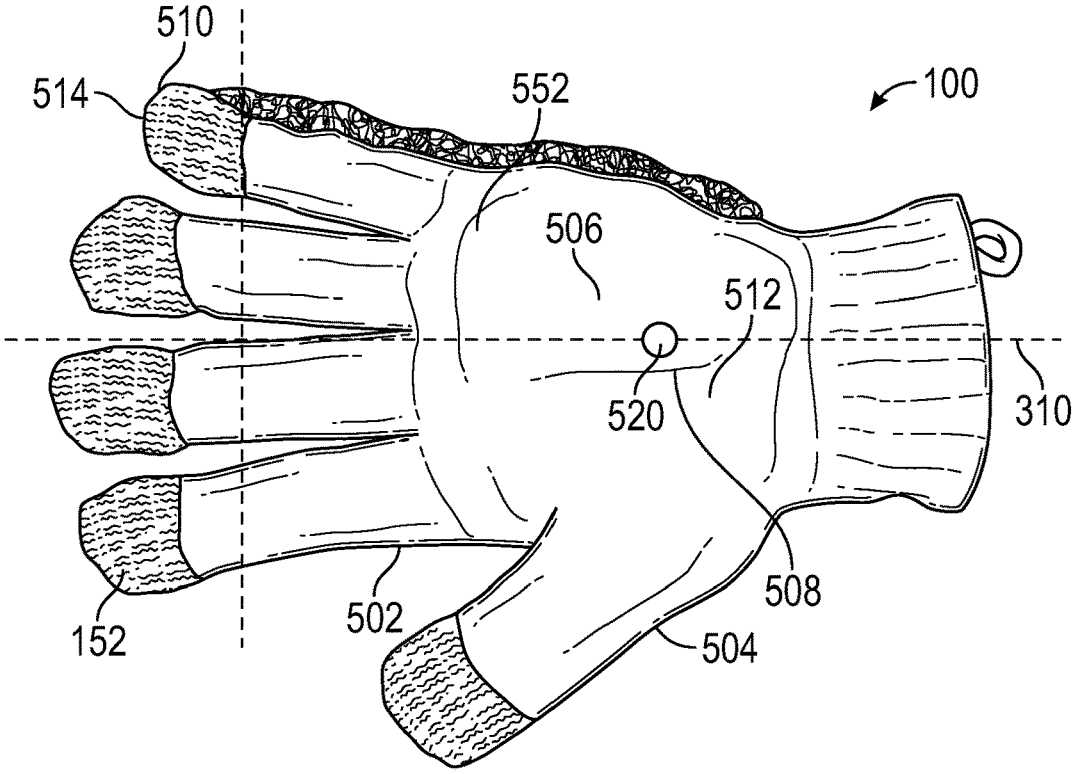
FIG. 8 is a bottom view of the hand wearable cleaning device of FIG. 1, which includes the plurality of abrasive pads and the cleaning strip.

Specifically referring to FIG. 8, the cleaning glove 100 is formed by intertwining a plurality of fibers 502 comprising exfoliating properties and/or rough texture. The plurality of fibers 502 are intertwined to form an outer periphery 504 and an outer primary textile 506 of the cleaning glove 100. The outer primary textile 506 of the cleaning glove 100 may include different textile patterns to provide different textures. In some embodiments, the texture may be a rough texture that includes a plurality of ridges 508. The plurality of ridges 508 may be formed parallel to the primary sagittal plane 310, perpendicular to the primary sagittal plane 310 and/or diagonally to the primary sagittal plane 310. In some embodiments, the plurality of ridges 508 may form a repeating pattern of a polygon. The outer primary textile 506 provides the benefits of the physical exfoliator while providing the benefits of cleaning outer surfaces of the bathtub and the tiles of a bathroom wall.

The cleaning glove 100 includes an abrasive pad 152 disposed within a distal region 510 of each finger of the cleaning glove 100 and is affixed individually and immediately above the outer primary textile 506. In the present disclosure, the abrasive pad 152 is affixed to a palmar surface 512 of the cleaning glove 100 and is formed integrally with a distal periphery 514 of cleaning glove 100. In some embodiments, the abrasive pad 152 may be affixed to the palmar surface 512 and a dorsal surface 516 of the cleaning glove 100, and the abrasive pad 152 may be formed separately with the distal periphery 514 of the cleaning glove 100. In some embodiments, the materials used for forming the abrasive pad 152 may be more abrasive than the materials used for forming the outer periphery 504 and the outer primary textile 506 of the cleaning glove 100. The abrasive pad 152 comprises or consists of abrasive grains, fibers, and/or filaments adhered onto the surface of a cloth, film, fiber, yarn, or nonwoven textile. In the present disclosure, the abrasive pad 152 is formed by intertwining the yarn and integrally with the distal periphery 514 of the cleaning glove 100. The abrasive pads 152 may be used for cleaning the tiles and the outer surfaces of the bathtub. In some embodiments, the palmar surface 512 of the cleaning glove 100 may include an abrasive patch (not shown) defined within a center 520 of the palmar surface 512. The abrasive patch may include different shapes and may comprise different drawings and/or writings. The abrasive patch may be formed integrally with the cleaning glove 100.

Figure 9:
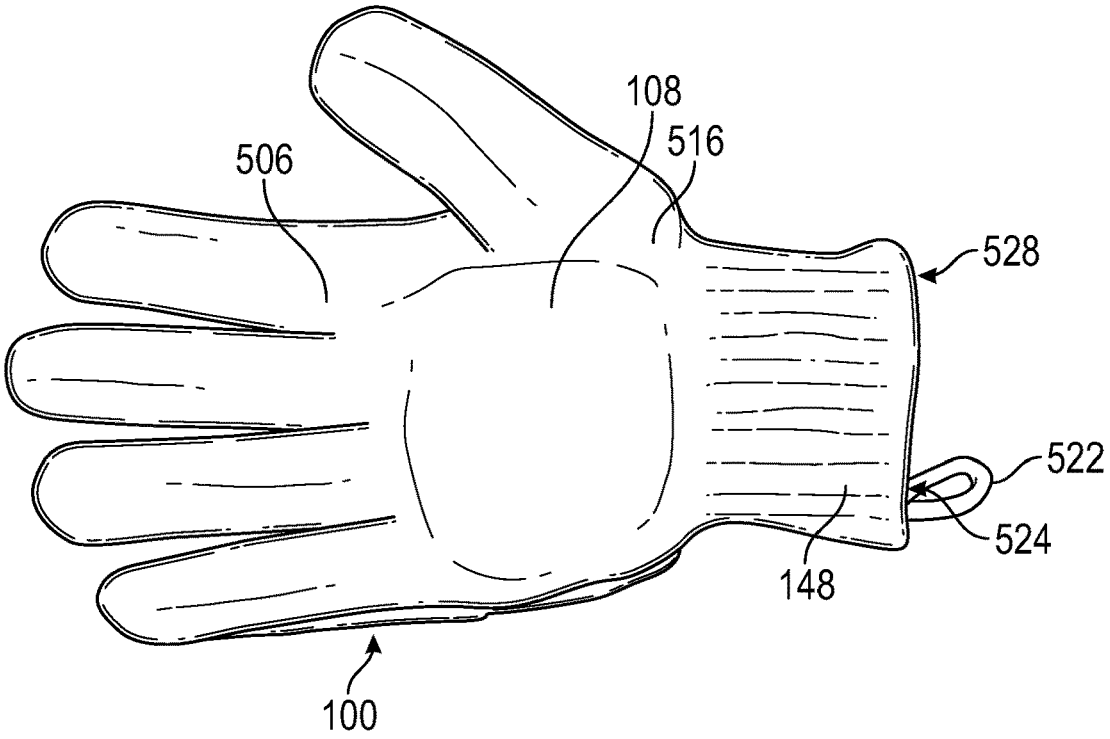
FIG. 9 is a top view of the hand wearable cleaning device of FIG. 1.

Referring now to FIG. 9, the cleaning glove 100 includes a hanging loop 522 that extends from an interior side 524 of the cuff 148. The hanging loop 522 enables hang drying of the wet cleaning gloves by hanging onto a hook. The drying process of the cleaning glove 100 after use aids with the prevention of bacterial growth, transfer of harmful pathogens, and odor caused by the damping of the cleaning glove 100. The hanging loop 522 may be formed integrally with the cleaning glove 100 and may be formed from the same exfoliating material that forms the outer primary textile 506. The dorsal surface 516 of the cleaning glove 100 is the opposite of the palmar surface 512 of the cleaning glove 100. The dorsal surface 516 is formed of the same exfoliating material that forms the outer primary textile 506. In some embodiments, the dorsal surface 516 of the cleaning glove 100 may include different design patterns and features. The dorsal surface 516 of the cleaning glove and the palmar surface 512 of the cleaning glove are delineated by a traverse plane TP (Refer to FIG. 10) of a body part or a bone part. The adjoining of the dorsal surface 516 of the cleaning glove 100 and the palmar surface 512 of the cleaning glove 100 form the body 108 of the cleaning glove 100. The body 108 includes an interior volume 528 where the right hand 200 may be received by the cleaning glove 100.

Figure 10:
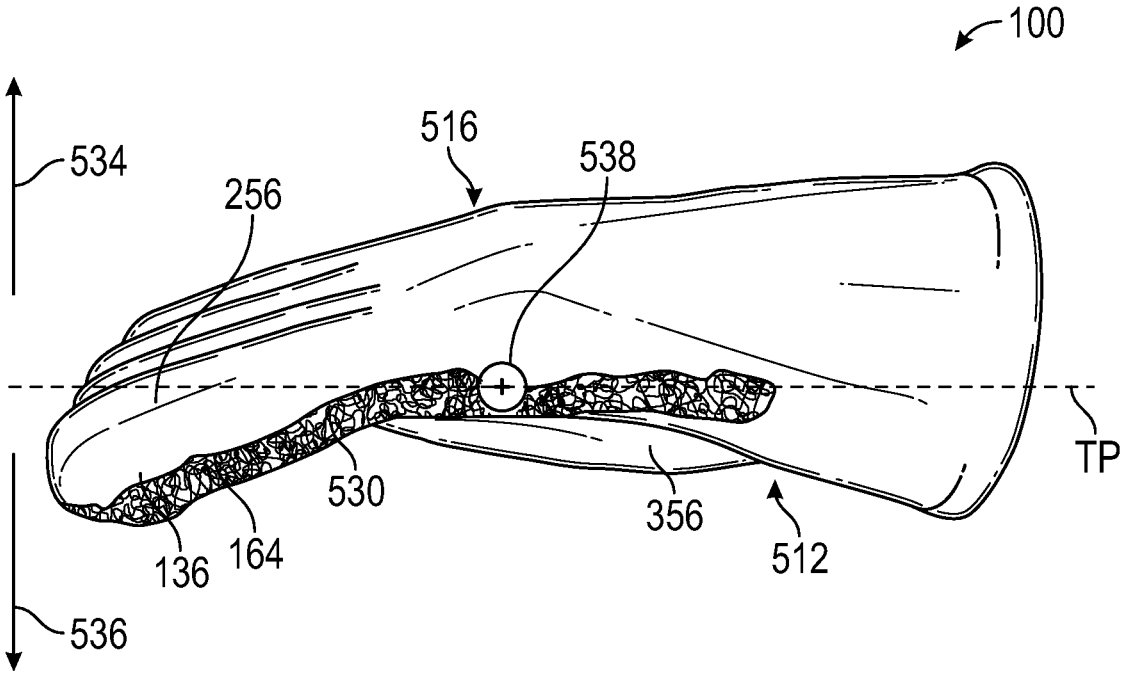
FIG. 10 is a left side view of the hand wearable cleaning device of FIG. 1.

Referring now to FIG. 10, the cleaning glove 100 further includes a cleaning strip 530 that is formed integrally with the outer periphery 504 of the cleaning glove 100 and is disposed along the traverse plane TP of the inner edge 356 of the right hand 200 and extends along the outer fourchette 164 of the little finger 136. The traverse plane TP divides a bone part into an upper side 534 and a lower side 536 about a centroid 538 of the bone part. The upper side 534 of the traverse plane TP may be defined as the dorsal surface 516 and the lower side 536 of the traverse plane TP may be defined as the palmar surface 512. For example, the distal phalange 256 may be separated by the traverse plane TP about the centroid of the distal phalange 256. The traverse plane TP of the bone part may be different from each other. In some embodiments, the cleaning strip 530 can be made separately and then coupled to the cleaning glove 100. For example, as illustrated in FIG. 10, the cleaning strip 530 can be woven or knitted onto the cleaning glove 100 along the outer fourchette 164 of the little finger 136. The cleaning strip 530 may be formed of abrasion resistant, durable, and rough texture materials that may be suitable for aggressive scrubbing.

Figure 11:
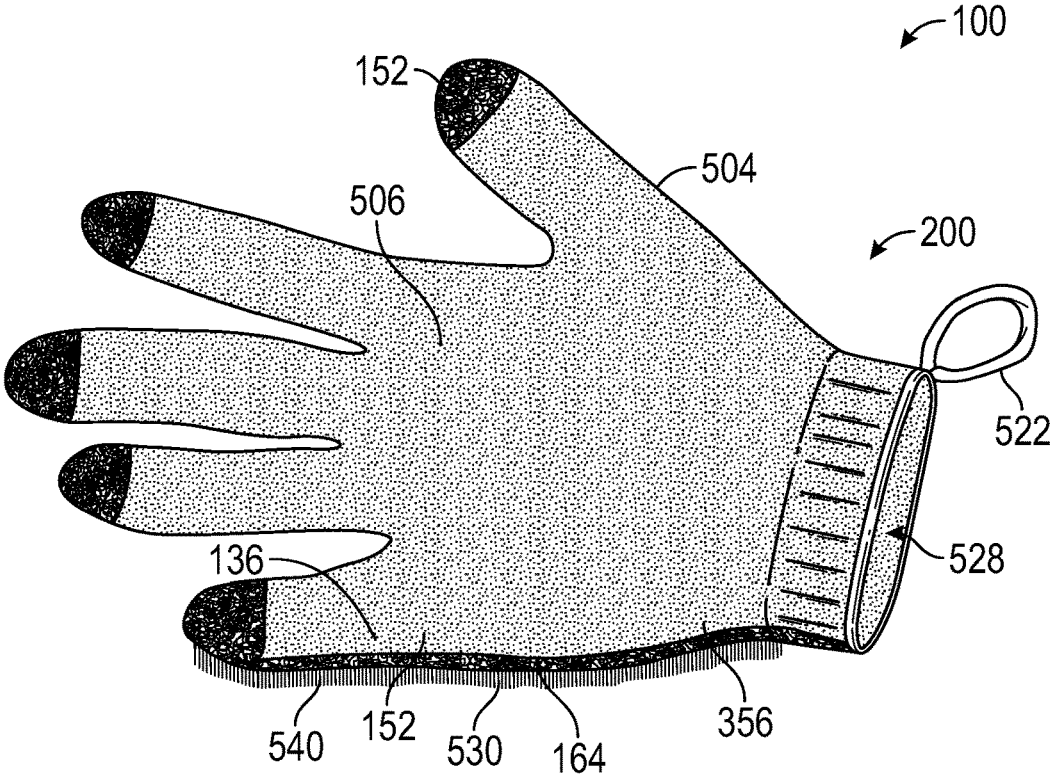
FIG. 11 is a schematic illustration of another hand wearable cleaning device in accordance with the present disclosure, which includes a bristled cleaning strip.
Figure 12:
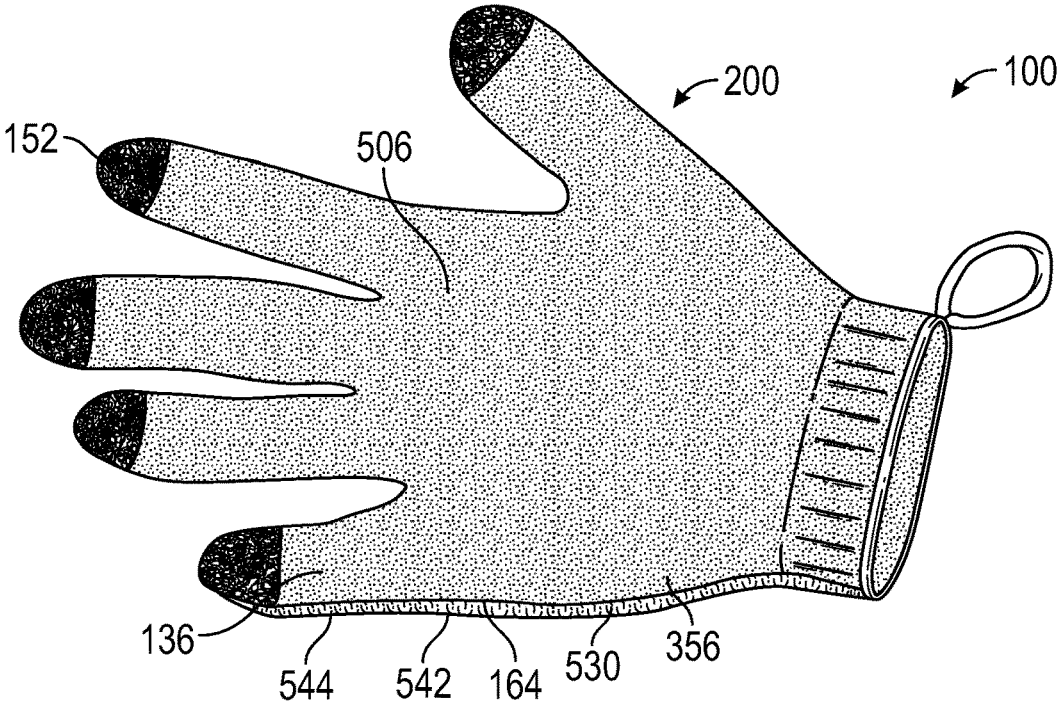
FIG. 12 is a schematic illustration of yet another hand wearable cleaning device in accordance with the present disclosure, which includes an abrasive tubular cleaning strip.

Referring to FIGS. 11 and 12, different configurations of the cleaning strip 530 may be defined along the inner edge 356 of the right hand 200 and along the outer fourchette 164 of the little finger 136 of the cleaning glove 100. Specifically referring to FIG. 11, the cleaning strip 530 may comprise a plurality of bristles 540. The plurality of bristles 540 may be formed from synthetic fibers, natural fibers, and/or metallic wires. The plurality of bristles 540 may provide easier accessibility to narrow areas such as a channel, a grout or a crevice. For example, the plurality of bristles 540 enables easier access to the grout formed between the tiles of a bathroom wall while the abrasive pad 152 and the outer primary textile 506 of the cleaning glove 100 may be used to clean the tiles. Additionally, the plurality of bristles 540 may be used as a fingernail brush or a toenail brush to remove the debris along the free distal edge 412 (see FIG. 6).

Referring now to FIG. 12, the cleaning strip 530 may comprise a tubular structure 542 that includes an abrasive outer surface 544. The tubular structure 542 may be a full tube shape or a half tube shape and may be formed integrally with the cleaning glove 100. The tubular structure 542 consists of abrasive grains, fibers, and/or filaments adhered onto the surface of the tubular structure 542. The tubular structure 542 may be formed of polymers and plastics which comprises water resistant properties and durability to abrasion. Similar to the plurality of bristles 540 shown in FIG. 11, the tubular structure 542 with the abrasive outer surface 544 provides easier access to narrow areas and provides similar benefits thereof.

Figure 13:
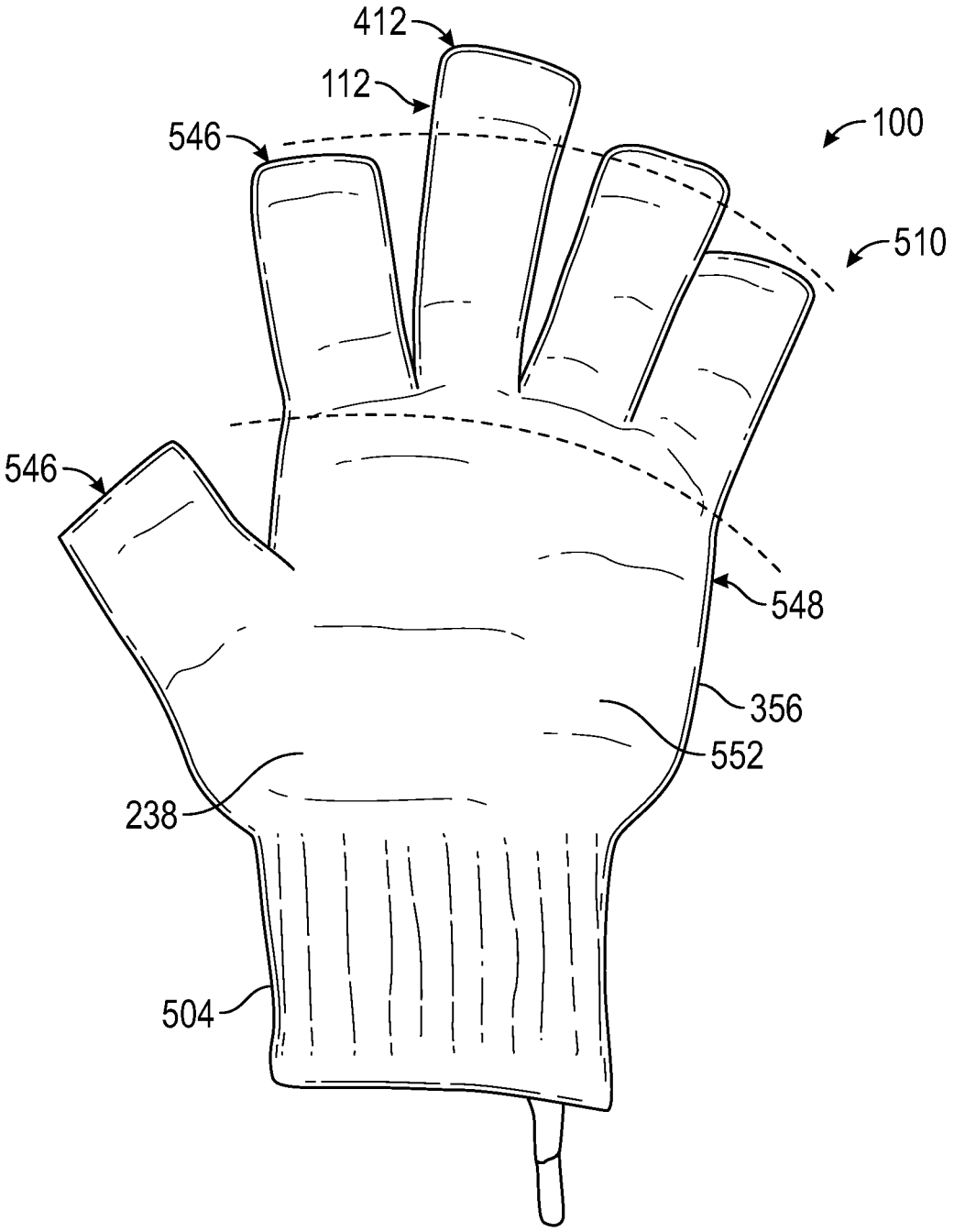
FIG. 13 is a top view of still another hand wearable cleaning device in accordance with the present disclosure, which includes an opening along the distal interphalangeal joints adjacent to the distal region.

Referring now to FIG. 13, another aspect of the current embodiment includes an opening 546 disposed along the distal interphalangeal joint 260 of each finger of the cleaning glove 100. The opening 546 accommodates for the free distal edge 412 of the nail plate 404 and/or a fake fingernail after nailcare (See FIG. 6), i.e., after receiving a manicure. The cleaning glove 100 without the opening may harm the manicured fingernails or can damage fake fingernails that are long. The abrasive pads 152 are defined between the distal region 510 and a proximal region 548 of the plurality of fingers extension 112 on the palmar surface (not shown) of cleaning glove 100 above a ball 552 of the right hand 200. The ball 552 of the hand is located between the metacarpal bones 238 and the proximal phalange 254 and at the base of where the plurality of finger extensions 112. The cleaning strip is affixed to the outer periphery 504 of the cleaning glove 100 and is defined along the inner edge 356 of the right hand 200.

Figure 14:
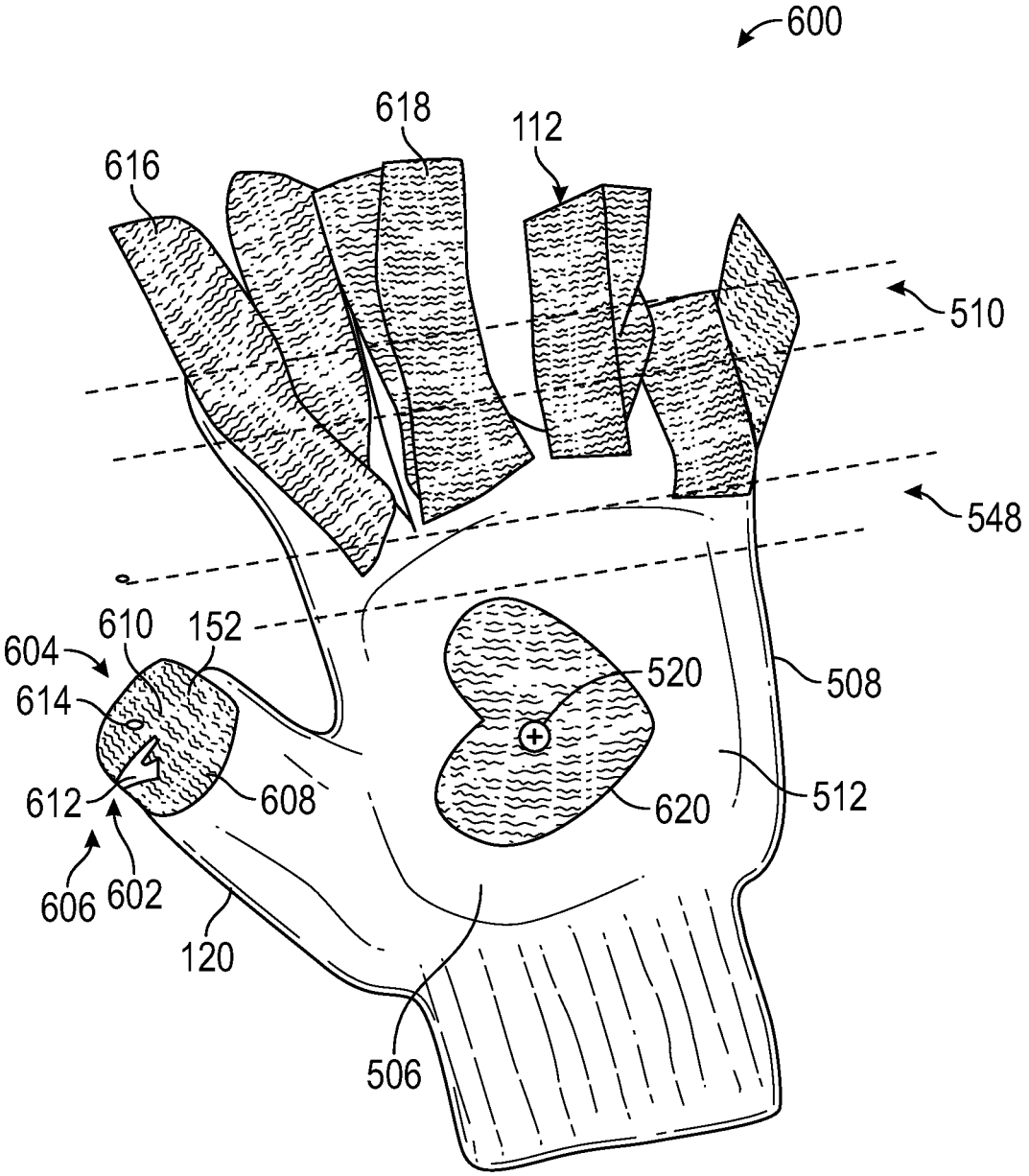
FIG. 14 is a front view of another hand wearable cleaning device in accordance with the present disclosure, which includes a plurality of abrasive cleaning strips.
Figure 15:
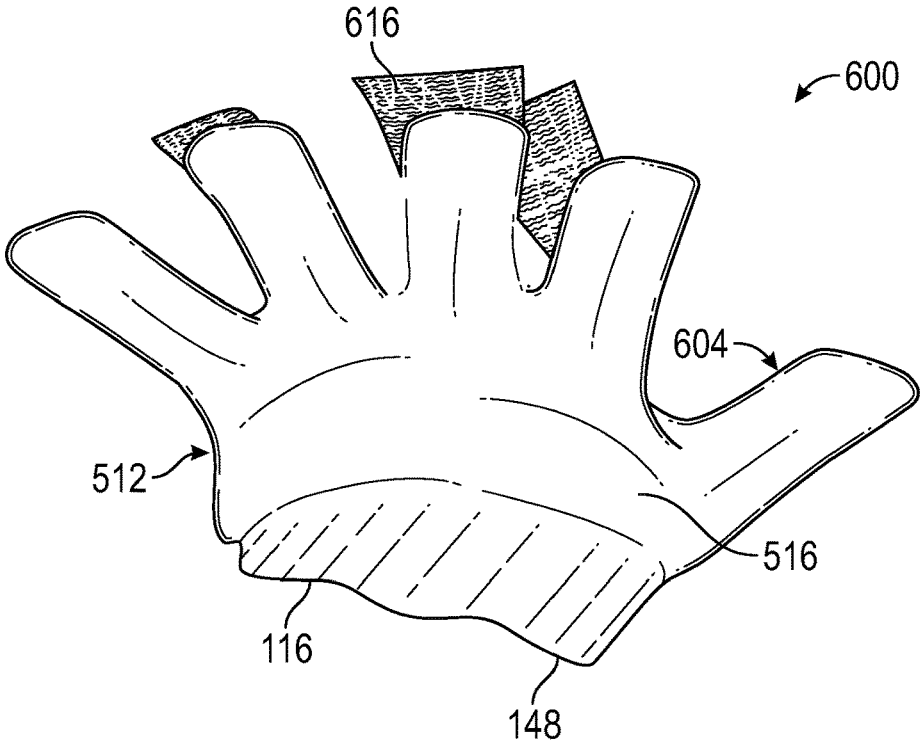
FIG. 15 is a bottom, perspective view of the hand wearable cleaning device of FIG. 14.
Figure 16:
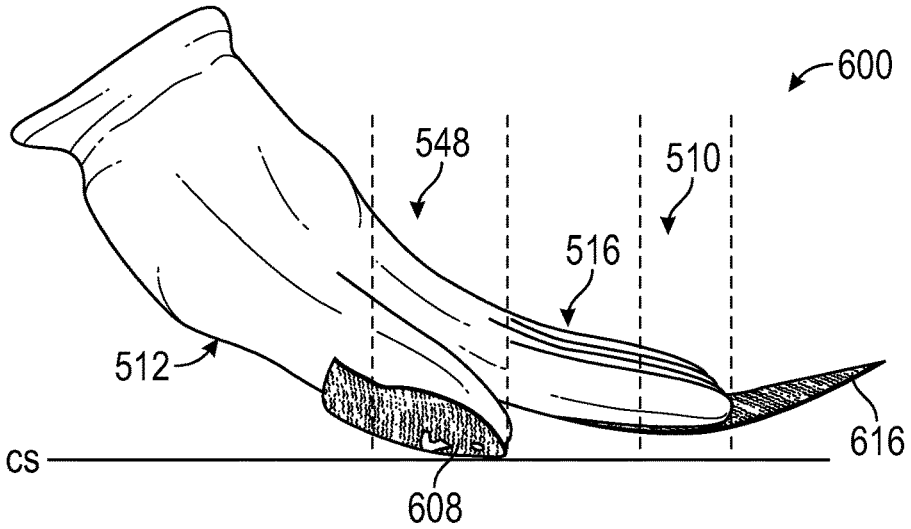
FIG. 16 is a side view of the hand wearable cleaning device of FIG. 14.

Referring to FIG. 14-16, another cleaning glove in the form of a children's cleaning glove 600 is shown, which includes a puppet-like configuration 602. Referring to FIG. 14, the outer periphery 504 and the outer primary textile 506 of the children's cleaning glove 600 are formed from a lighter exfoliating material to accommodate for a child's skin. The outer primary textile 506 of the children's cleaning glove 600 may include a smaller number of the plurality of ridges 508 to reduce the roughness of the children's cleaning glove 600. Additionally, the abrasive pad 152 is formed from less abrasive material to accommodate for children's skin. The children's cleaning glove 600 is configured as a shape of an animal 604 by emphasizing the features of the animal. For example, in the present disclosure, the children's cleaning gloves 600 is configured as a bird 606 puppet. The thumb 120 includes a lighter abrasive pad 608 which defines a head 610 of a bird 606, and a beak 612 and an eye 614 of the bird 606 is etched on to the lighter abrasive pad 608. The plurality of finger extensions 112 includes an abrasive strip 616 extending from the proximal region 548 of the children's cleaning glove 600 and beyond the distal region 510 of the children's cleaning glove 600. The abrasive strip 616 disposed along the plurality of finger extensions 112 defines a wing structure 618 of the bird 606. Additionally, the palmar surface 512 of the children's cleaning glove 600 may include a patch 620 partially defined within the center 520 of the palmar surface 512. The patch 620 may include different shapes and may comprise different drawings and/or writings. The patch 620 may be formed integrally with the children's cleaning glove 600. In some embodiments, the patch 620 may be formed separately from the palmar surface 512 of the children's cleaning glove 600.

Referring now to FIG. 15, a dorsal view is shown of the children's cleaning glove 600 of FIG. 14. In some embodiments, the dorsal surface 516 of the children's cleaning glove 600 may mirror the feature of the shape of an animal 604 from the palmar surface 512. The children's cleaning glove 600 includes the cuff 148 extending from the wrist 116, partially covering a head portion (not shown) of the ulna 204 and a head portion (not shown) of the radius 206 of a forearm (not shown). In some embodiments, the cuff 148 may include a hanging loop (not shown) to enable hang drying of the children's cleaning gloves 600. Referring now to FIG. 16, the children's cleaning glove 600 including the lighter abrasive pad 608 and the abrasive strip 616 tangentially disposed along a cleaning surface CS. The cleaning surface CS may be an elastic surface like the epidermis 402 of a user's skin for exfoliation or may be a hard surface of the bathtub or the tiles of the bathroom wall for cleaning.

As illustrated in FIGS. 8-16, the hand wearable cleaning device can be a cleaning glove 100, 600 which includes separate compartments for each individual finger and thumb. The separate compartments of the cleaning glove can provide dexterity and flexibility. For example, different fingers can be used at different angles for hard to each area (e.g., small or narrow areas) and different number of fingers can be selected to control the intensity of exfoliation or scrubbing.

Figure 17:
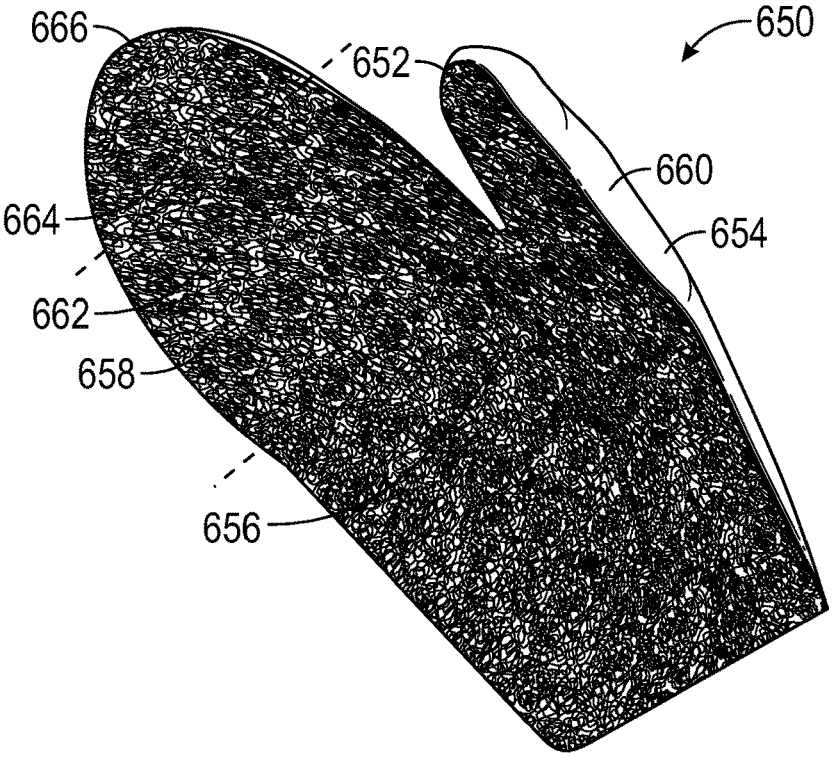
FIG. 17 is a perspective view of another hand wearable cleaning device in accordance with the present disclosure.
Figure 18:
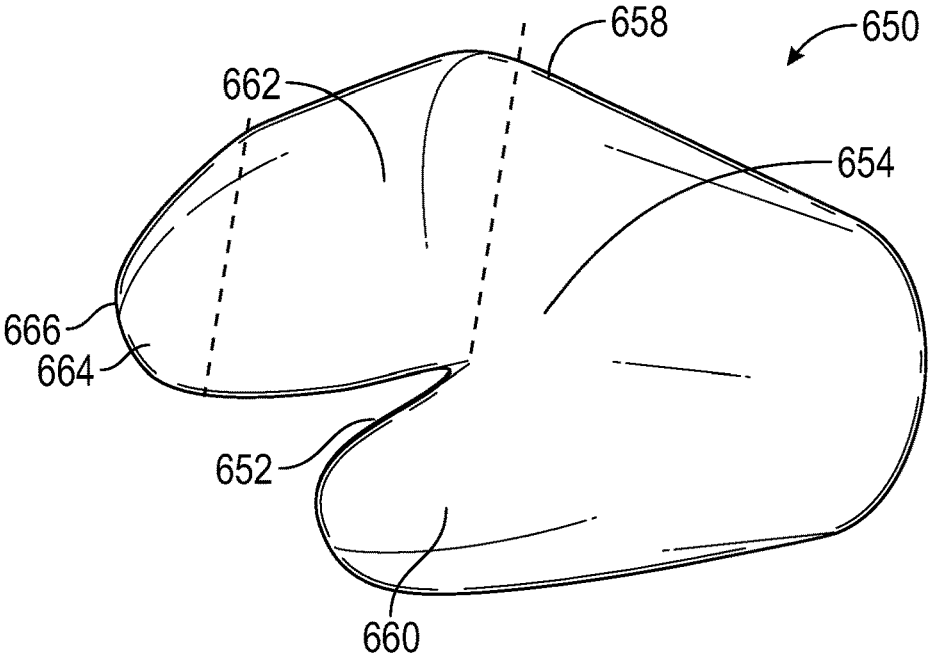
FIG. 18 is a top, perspective view of the hand wearable cleaning device of FIG. 17.

Alternatively, the hand wearable cleaning device can be a mitten. FIGS. 17 and 18 illustrates a cleaning mitten 650. Referring to FIG. 17, the cleaning mitten 650 includes a shell 652 formed from a dorsal layer or first layer 654 and a palmar layer or second layer 656. The shell defines an interior volume and an opening, and the opening configured to receive a hand within the interior volume. As a non-limiting example, in the illustrated embodiment, the first layer 654 and the second layer 656 are coupled via weaving. The shell 652 includes a first compartment 658 including all the fingers (e.g., index finger 124, middle finger 128, ring finger 132, and little finger 136) and a second compartment 660 enclosing the thumb 120. The first compartment 658 includes a hand portion 662 extending between the metacarpal bones 238 and the distal phalanges 256 and a closure portion 664 extending between a distal tip 666 of the cleaning mitten 650 and the distal phalanges 256. In some embodiments, the cleaning mitten 650 may include a hanging loop (not shown).

Still referring to FIGS. 17 and 18, the first layer 654 includes a first material and the second layer 656 includes a second material that is different from the first material. For instance, referring to FIG. 18, the first material of the first layer 654 may be softer than the second material of the second layer 656. For example, the second layer 656 may include an abrasive material to provide extra friction and the first layer 654 may include a softer material (e.g., sponge, cloth) for gentle reduced friction, or vice versa. Alternatively, the first and second layers 654, 656 may be formed from identical material.

As illustrated in FIG. 17, the entirety of the second layer 656 can be formed from an abrasive second material as discussed above. However, in some embodiments, the second layer 656 may include different materials depending on the region of the cleaning mitten 650. As a non-limiting example, the second layer 656 of the first compartment may include abrasive material and the second layer of the second compartment may include a different material. In some examples, the closure portion 664 of the second layer 656 may include abrasive material. In some examples, the second layer 656 may include a pattern (not shown) that is defined by the abrasive material. The pattern can be a uniform pattern comprising different geometries (e.g., circle, ovals, triangles, squares) or can be a nonlinear pattern comprising different geometries. In some embodiments, the cleaning mitten 650 can be a children's mitten and include attachment pads or strip to resemble a puppet as illustrated in FIG. 14.

Referring again to FIG. 1, the process of exfoliation comprises an initial step of soaking various portions of the epidermis 402 of the user's skin and scrubbing in a gentle circular motion to buff the user's skin. After an initial scrub, different cleaning products may be applied to the epidermis 402. Additional scrubbing may be applied to a less sensitive area of the skin to remove additional dead skin cells. The scrubbing or the exfoliation of epidermis 402 primarily occurs by the palmar surface 512 of the cleaning glove 100. Conventionally, exfoliation or scrubbing takes place between the distal region 510 and the proximal region 548 of the palmar surface 512. The sensibility of the plurality of finger extensions 112 allows the user to effectively exfoliate by controlling the force exerted to the epidermis by the cleaning glove 100.

Figure 19:
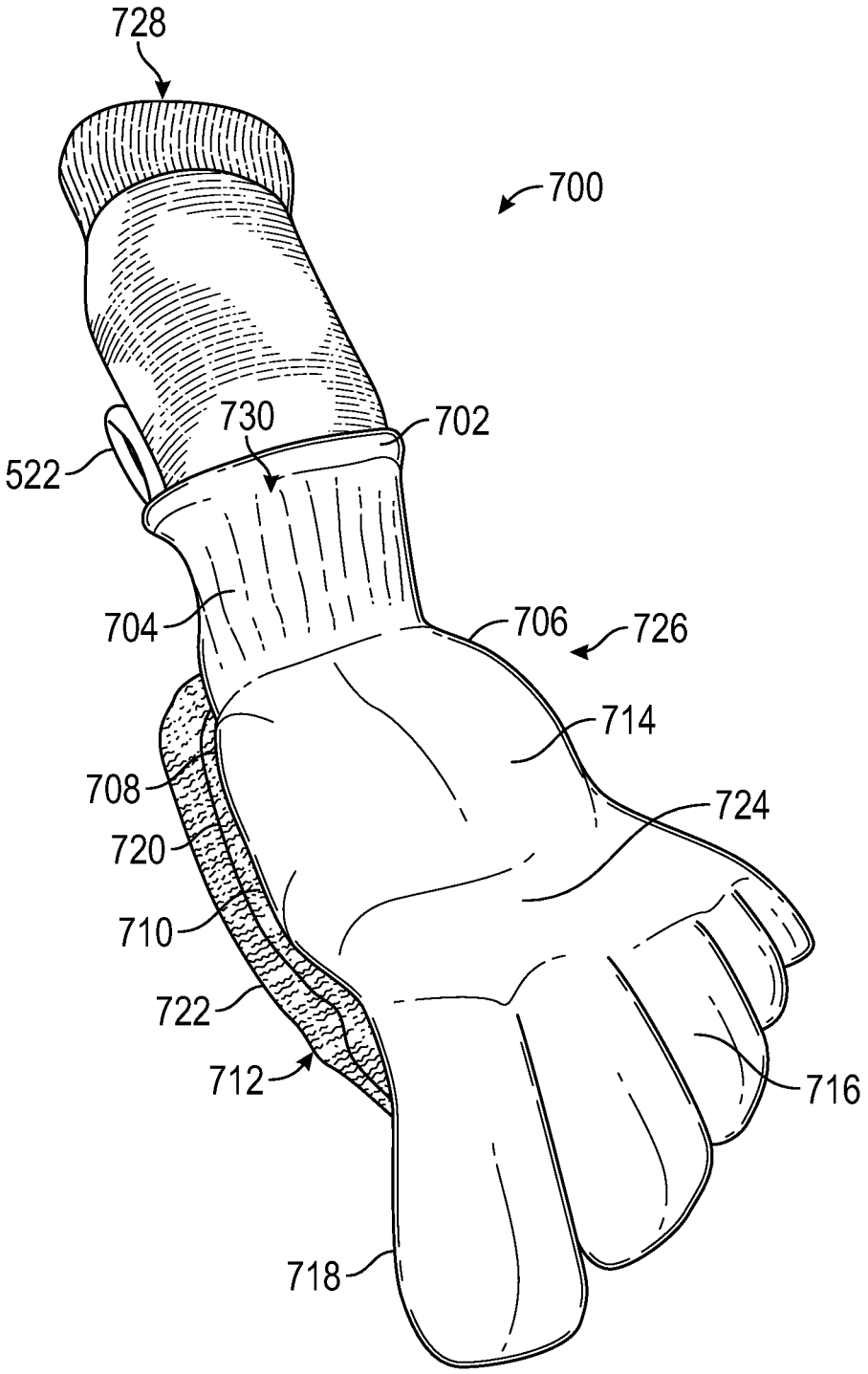
FIG. 19 is a perspective view of a foot wearable cleaning device in accordance with the present disclosure, which includes a plurality of abrasive pads and an abrasive pocket.

FIG. 19 illustrates a foot wearable cleaning device, specifically in a form of a cleaning sock 700. The cleaning sock 700 includes a cuff portion 702, a leg portion 704, a heel flap portion 706, a heel turn portion 708, a gusset portion 710, a foot or a sole portion 712, an instep portion 714, and a toe portion 716. The toe portion 716 of the cleaning sock 700 may be individually encasing each toe 718, the same way each finger is encased within the cleaning glove 100. The sole portion 712 of the cleaning sock 700 may include an inner abrasive layer 720 and an outer abrasive layer 722. The cuff portion 702 of the cleaning sock 700 may include a hanging loop 522 (see FIG. 22) to hang the cleaning sock 700 for hang drying. The entirety of the cleaning sock 700 may be formed from exfoliating materials which form an outer base textile 724. In some embodiments, a non-exfoliating material may be used jointly with the outer base textile 724 to form the leg portion 704 and the cuff portion 702 of the cleaning sock 700. The cleaning sock 700 may be worn over the foot 726 by inserting the foot 726 into an inner volume 728 defined by the toe portion 716, instep portion 714, sole portion 712, gusset portion 710, heel turn portion 708, heel flap portion 706, leg portion 704 and the cuff portion 702. The cuff portion 702 defines an aperture 730 of the inner volume 728 of the cleaning sock 700 and the foot 726 is inserted through the aperture 730.

Figure 20:
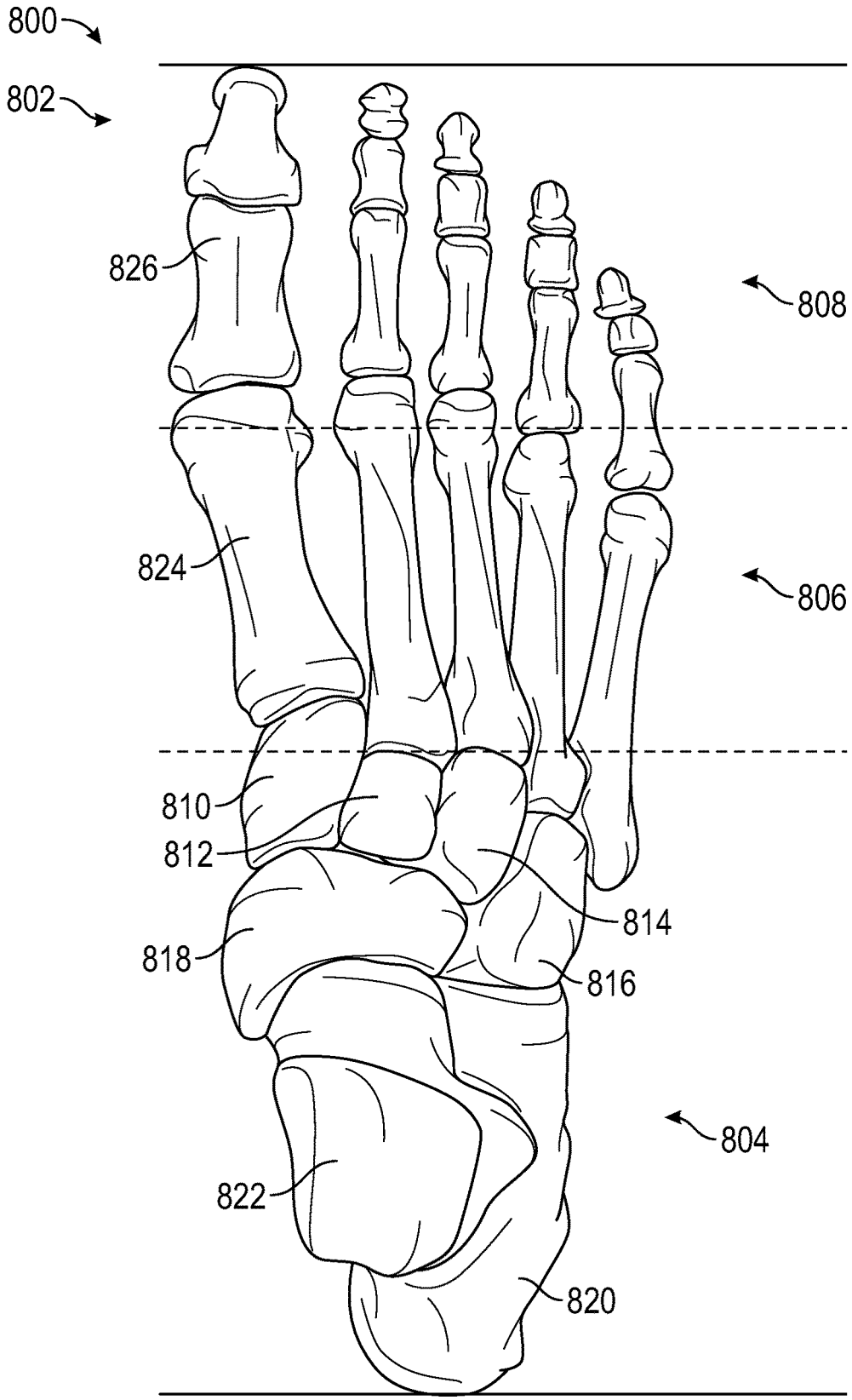
FIG. 20 is a top posterior view of a user's skeletal right foot structure.
Figure 21:
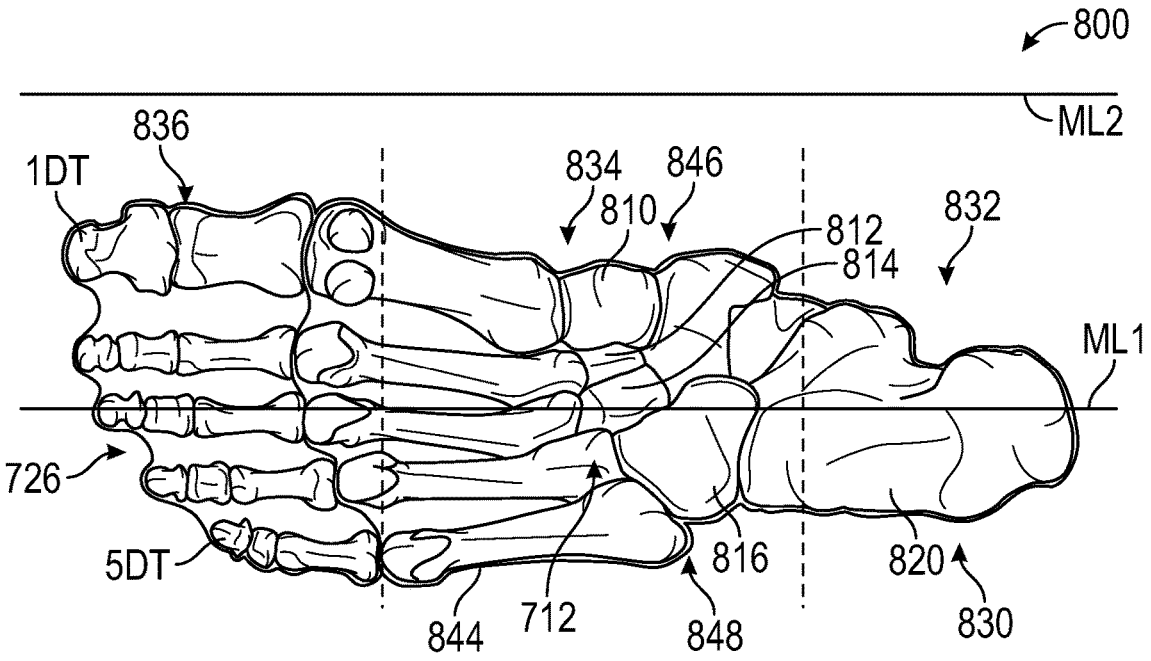
FIG. 21 is a top anterior view of the user's skeletal right foot structure.
Figure 22:
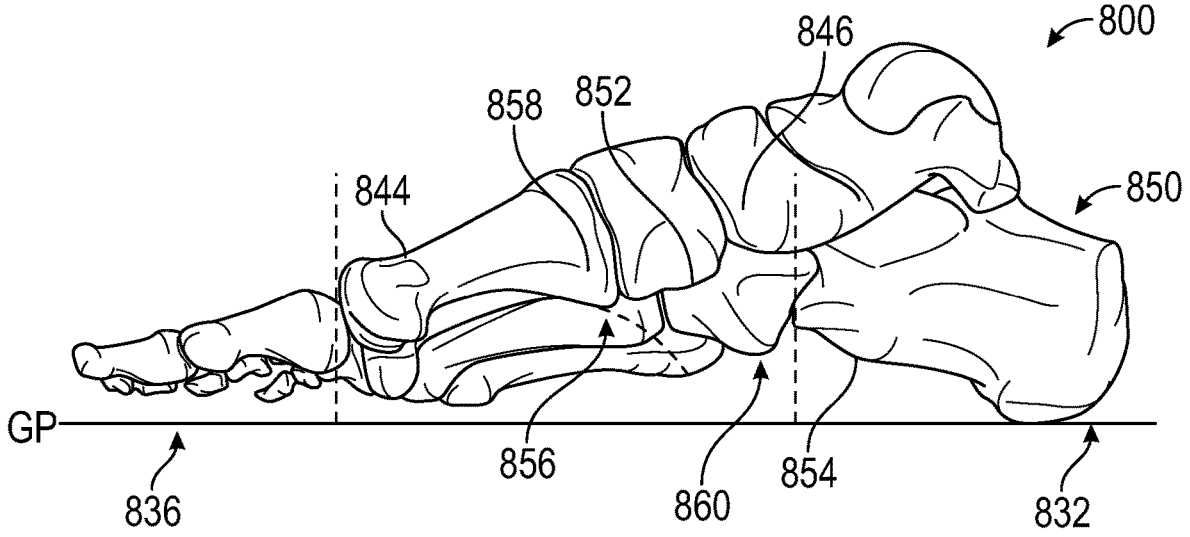
FIG. 22 is a medial view of the user's skeletal right foot structure.

Referring now to FIGS. 20-22, a skeletal anatomy of a right foot 800 including 26 bones in shown. Specifically referring to FIG. 20, a dorsal view 802 of the right foot 800 is shown. The right foot 800 can be anatomically compartmentalized into a tarsal section 804, a metatarsal section 806, and a phalange section 808. The tarsal section 804 of the right foot 800 includes a medial cuneiform 810, an intermediate cuneiform 812, a lateral cuneiform 814, a cuboid 816, a navicular 818, a calcaneus 820, and a talus 822. The tarsal section 804 is adjacent to a tibia (not shown) and a fibula (not shown) of the right foot 800 that extends toward a knee (not shown). The metatarsal section 806 includes 5 metatarsals bones 824 extending between the tarsal section 804 and the phalange section 808. The phalange section 808 includes 14 phalange bones 826 extending away from the metatarsal bones 824.

Referring now to FIG. 21, a plantar view 830 of the right foot 800 is shown. The right foot 800 can be functionally compartmentalized into three different regions. The region including the talus 822 and the calcaneus 820 is called a hindfoot region 832. The region including the medial cuneiform 810, the intermediate cuneiform 812, the lateral cuneiform 814, the cuboid 816, the navicular 818 and the five metatarsal bones 824 is called a midfoot region 834, and the region including the fourteen phalange bones of the right foot 800 is called a forefoot region 836. The hindfoot region 832 functions to bear and distribute weight to the foot 726 while standing and enables complex foot movements in coordination with the tibia (not shown) and the fibular (not shown) around an ankle joint (not shown) by providing movement such as an eversion, an inversion, a dorsiflexion, and a plantarflexion. The eversion is the rotation of the sole portion 712 of the right foot 800 away from a midline ML1 of the right foot 800.

The inversion is the rotation of the sole portion 712 inwards toward the midline ML1 of the right foot 800. A midline ML2 of the human body is shown parallel to the midline ML1 of the right foot 800. An outermost periphery 844 of the right foot 800 is defined between the midline ML1 of the right foot 800 and the midline ML2 of the human body which further defines a medial side 846 of the right foot 800. The medial side 846 of the right foot 800 extends between a first digit of the toe 1DT and the calcaneus 820, along the outermost periphery 844 of the right foot 800 and defined inwardly toward the midline ML2 of the human body. A lateral side 848 of the right foot 800 is defined between a fifth digit of the toe 5DT and the calcaneus 820, along the outermost periphery 844 of the right foot 800 and opposite to the medial side 846 of the right foot 800.

Referring now to FIG. 22, a medial view 850 of the right foot 800 is shown with respect to a ground plane GP. The outermost periphery 844 along the medial side 846 of the right foot 800 defines a medial longitudinal arc 852 between the hindfoot region 832 and the forefoot region 836. A lateral longitudinal arc 854 is defined opposite of the medial longitudinal arc 852, and a traverse arc 856 is defined between the medial longitudinal arc 852 and the lateral longitudinal arc 854 along a base 858 of the metatarsal bones 824. The medial longitudinal arc 852, the lateral longitudinal arc 854, and the traverse arc 856 defines a sole cavity 860.

Figure 23:
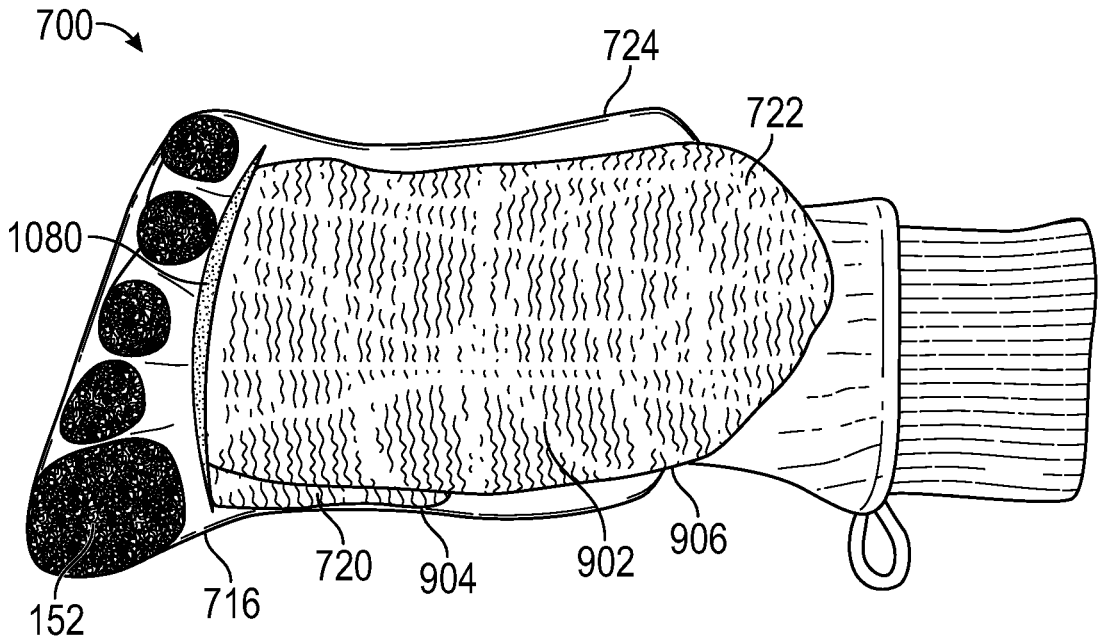
FIG. 23 is a bottom view of the foot wearable cleaning device of FIG. 19.
Figure 24:
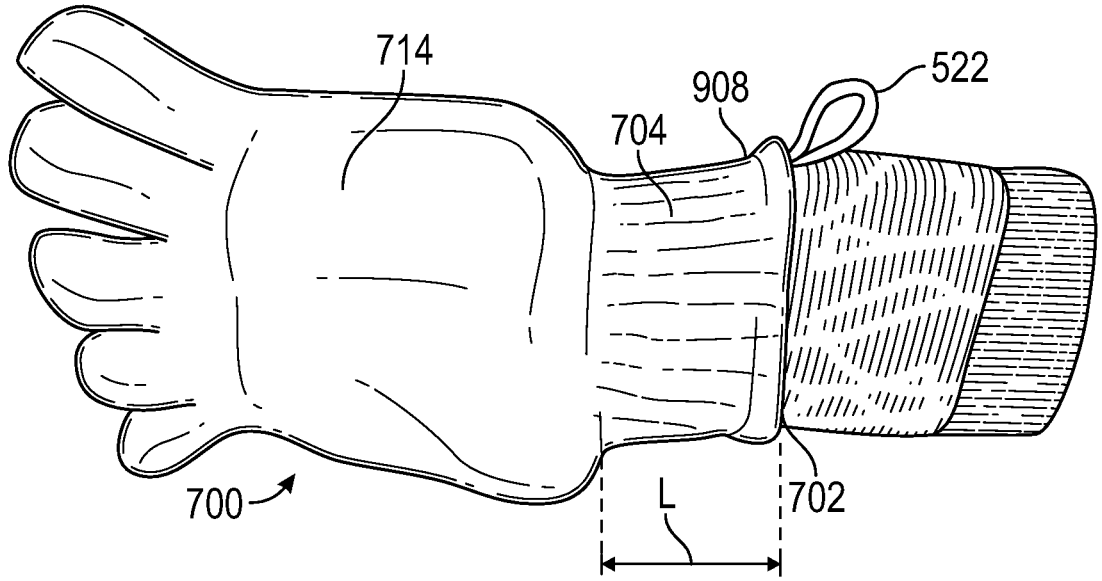
FIG. 24 is a top view of the foot wearable cleaning device of FIG. 19.
Figure 25:
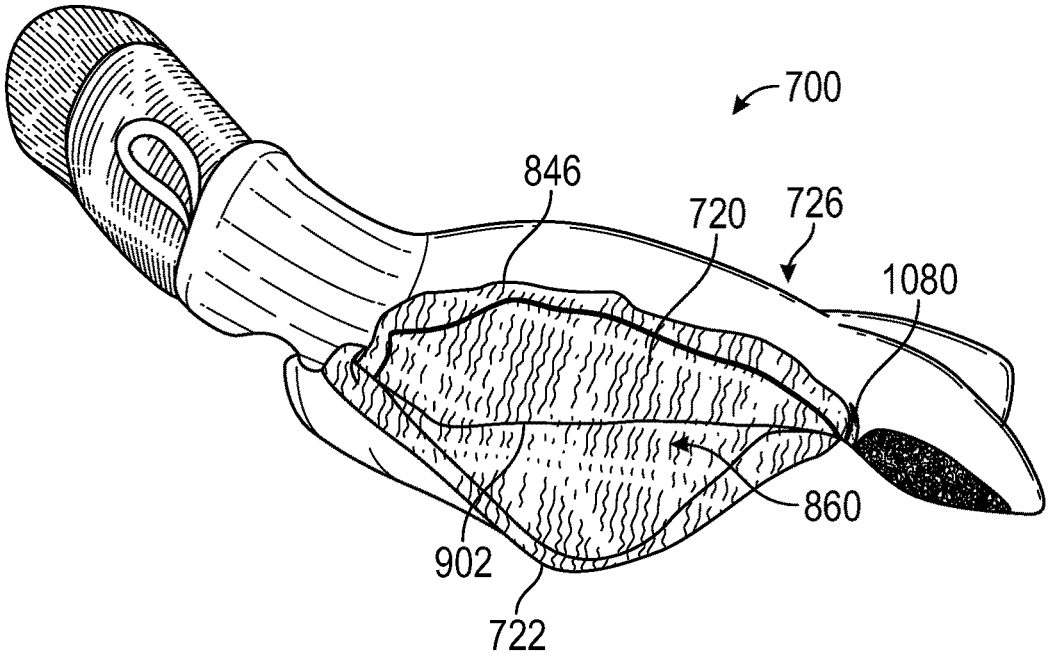
FIG. 25 is a side view of the foot wearable cleaning device of FIG. 19, which depicts an abrasive pocket.
Figure 26:
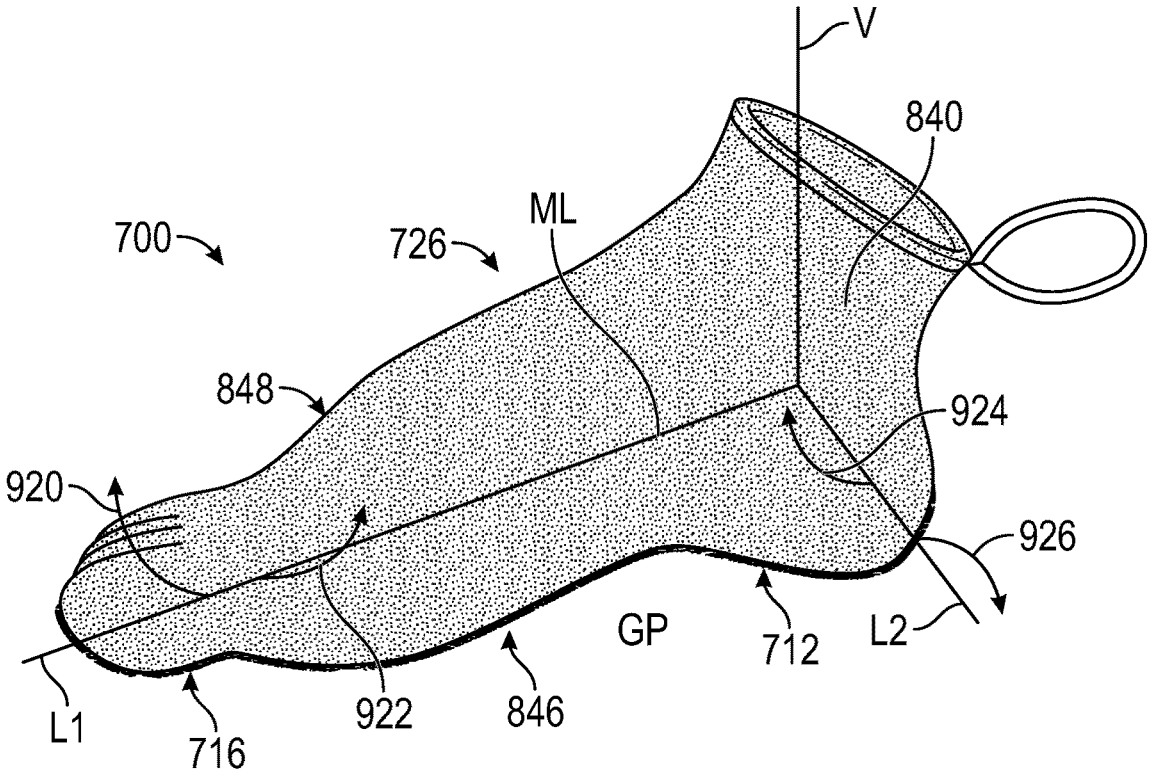
FIG. 26 is a schematic illustration of another foot wearable cleaning device that includes a plurality of abrasive pads and an abrasive pocket.

FIGS. 23-25 illustrate a cleaning sock 700 that can perform different motions configured by the human foot. The different motions that be performed by the human foot while wearing a cleaning device about the human foot are illustrated in FIG. 26. Specifically referring to FIG. 23, the individually encased toe portion 716 of the cleaning sock 700 includes the abrasive pad 152 and an abrasive pocket 902 (see FIG. 25). The abrasive pocket 902 is formed by the inner abrasive layer 720 and the outer abrasive layer 722 immediately above the outer base textile 724 of the cleaning sock 700. In some embodiments, the inner abrasive layer 720 may be formed integrally with the sole portion 712 of the cleaning sock 700. The inner abrasive layer 720 includes an inner abrasive layer perimeter 904 that is fully affixed to the sole portion 712 of the cleaning sock 700. The outer abrasive layer 722 includes an outer abrasive layer perimeter 906 that is partially affixed to the sole portion 712 of the cleaning sock 700 and/or the inner abrasive layer 720. In some embodiments, the medial side 846 of the outer abrasive layer perimeter 906 may not be affixed to form the abrasive pocket 902. In some embodiments, at least one side of the outer abrasive layer 722 is not affixed to the sole portion 712 of the cleaning sock 700. The abrasive pads 152 are affixed individually and immediately above the toe portion 716 to the outer base textile 724 of the cleaning sock 700.

Referring now to FIG. 24, the instep portion 714, the leg portion 704, the hanging loop 522, and the cuff portion 702 of the cleaning sock 700 is shown. In some embodiments, the cleaning sock 700 may be an ankle sock based on the length L of the leg portion 704. The hanging loop 522 extends from an ankle portion 908 of the cleaning sock 700. In some embodiments, the hanging loop 522 may extend from the cuff portion 702 of the cleaning sock 700.

Referring now to FIG. 25, the abrasive pocket 902 and the sole cavity 860 defined along the medial side 846 of the foot 726 is shown. The abrasive pocket 902 along the sole cavity 860 may be used to clean the bathtub and exfoliate the bottom of the foot 726. In some embodiments, a cleaner or a cleaning agent may be inserted into the abrasive pocket 902. The friction exerted between the inner abrasive layer 720 and the outer abrasive layer 722 dissolves the cleaner in the bathtub. The cleaner may be a solid cleaner or a liquid cleaner. The cleaner may comprise natural detergents, vinegar, baking soda, salt, potassium hydroxide (KOH), citric acid, essential oils, and colorant. The abrasive pocket 902 along the sole cavity 860 of the cleaning sock 700 provides slip resistant benefits. The friction emanated by the outer abrasive layer 722 is sufficient to provide traction with the slippery surface of the bathtub and securing the cleaner outside of the abrasive pocket 902. The addition of the outer abrasive layer 722 above the inner abrasive layer 720 provides additional durability for aggressive scrubbing during cleaning.

Figure 27:
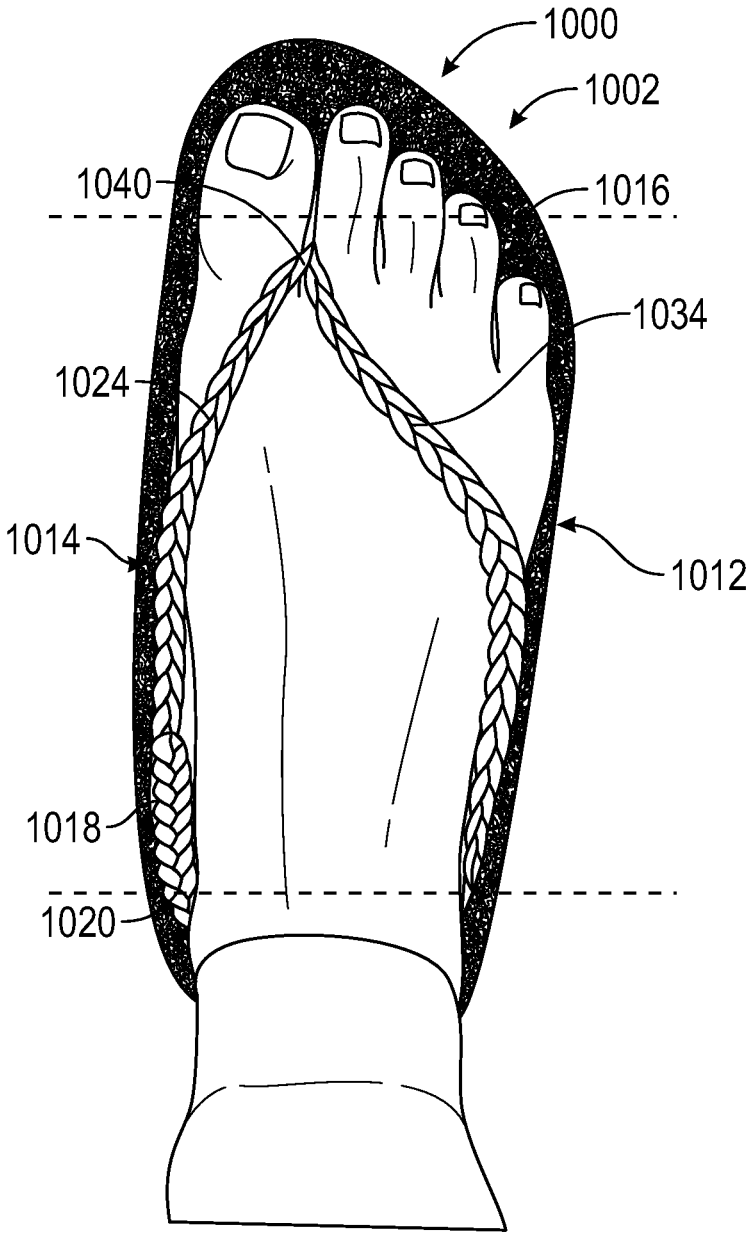
FIG. 27 is a top perspective view of another foot wearable cleaning device in accordance with the present disclosure.
Figure 28:
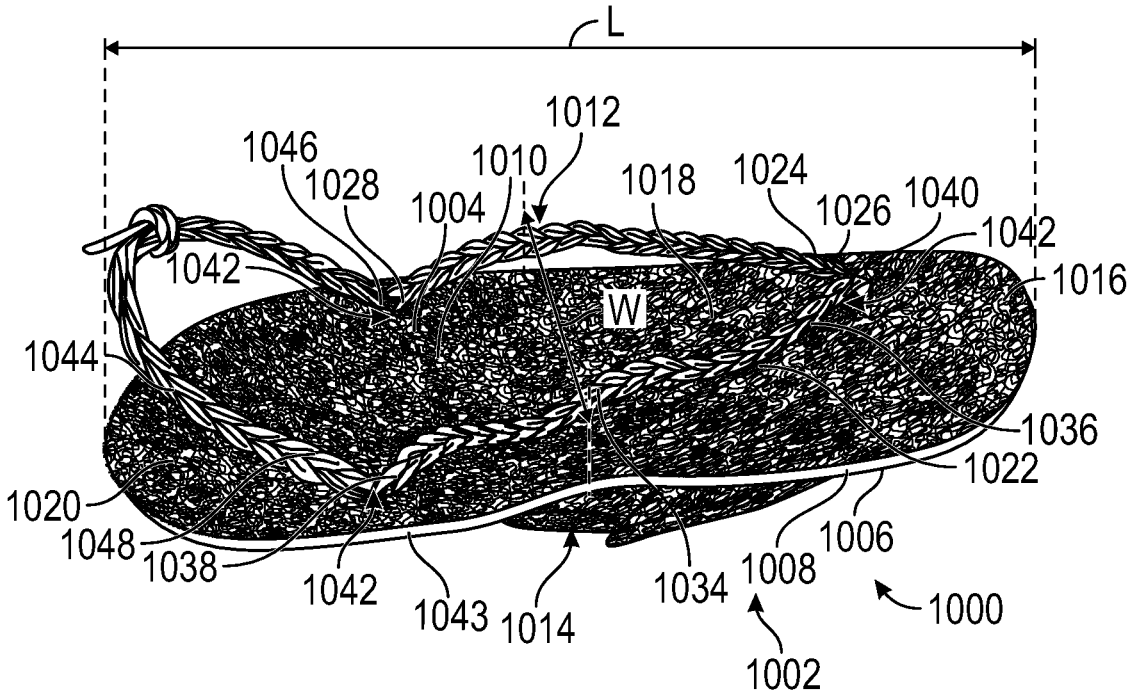
FIG. 28 is a top, left perspective view of the foot wearable cleaning device of FIG. 27, which depicts at least one strap.
Figure 29:
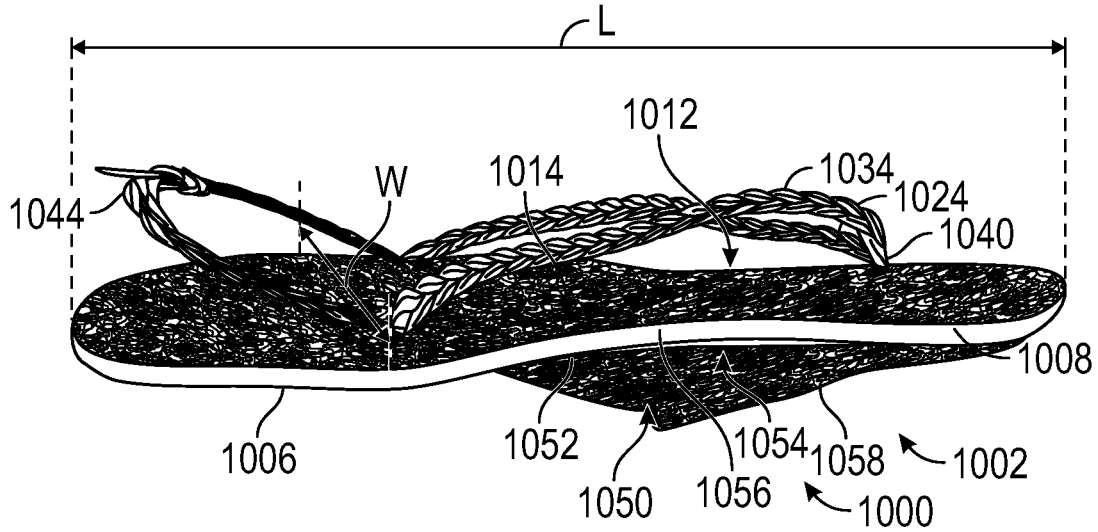
FIG. 29 is a left side view of the foot wearable cleaning device of FIG. 27, which depicts an abrasive pocket.

Alternatively, FIGS. 27-29 illustrate a foot wearable cleaning device, specifically in a form of an article of footwear. FIG. 27 illustrates an exemplary embodiment of a cleaning sandal 1000, more specifically a right cleaning sandal 1002. The right cleaning sandal 1002 includes a corresponding left cleaning sandal that includes similar components as the right cleaning sandal 1002. In some examples, at least one cleaning sandal 1000 can be worn while the foot remains bare and fixated to provide stability to the user while cleaning a surface.

Referring to FIG. 28, the cleaning sandal 1000 includes a sole structure 1004 comprising an outsole 1006, a midsole 1008 and a footbed or insole 1010. Similar to the cleaning socks, the right cleaning sandal 1002 defines a lateral side 1012 and a medial side 1014. When a user is wearing the cleaning sandal 1000, the lateral side 1012 corresponds with an outside-facing portion of the cleaning sandal 1000 while the medial side corresponds with an inside-facing portion of the cleaning sandal 1000. As such, the right cleaning sandal 1002 and the left cleaning sandal have opposing lateral sides and medial sides, such that the medial sides are closest to one another when the user is wearing the shoes, while the lateral sides are defined as the sides that are farthest from one another while the cleaning sandal 1000 is worn. The sole structure 1004 includes a forefoot region 1016, a midfoot region 1018 and a heel region 1020 that extends between the medial side 1014 and the lateral side 1012.

The sole structure 1004 includes straps 1022 that extend from different parts of the sole structure 1004. In the illustrated embodiment, a first strap 1024 includes a first end 1026 and a second end 1028 and a second strap 1034 includes a first end 1036 and a second end 1038. The first end 1026 of the first strap 1024 and the first end 1036 of the second strap are coupled to form a toe post 1040 between a first and second toe. The second end 1028 of the first strap 1024 extends from the toe post 1040 toward the medial side 1014 of the midfoot region 1018 and the second end 1038 of the second strap 1034 extends from the toe post 1040 toward the lateral side 1012 of the midfoot region 1018. The first strap 1024 and the second strap 1034 can be coupled via weaving, knitting, or wrapping to form the toe post 1040. In some examples, the first and second straps 1024, 1034 can be coupled using a tubular structure (not shown) to form the toe post 1040.

The toe post 1040 including the first ends 1026, 1036 of the first and second straps 1024, 1034 and the opposing second ends 1028, 1038 of the first and second straps 1024, 1034 can be secured to the sole structure 1004 by a plurality of apertures 1042. For example, the toe post 1040 can be coupled to the sole structure 1004 through at least one of the plurality of apertures 1042 that is disposed between the first and second toe. The plurality of apertures can be disposed substantially perpendicular to the bottom surface of the sole structure 1004. Additionally, the second ends 1028, 1038 of the first and second straps 1024, 1034 can be coupled to the sole structure 1004 through corresponding apertures 1042 that are spaced apart from an edge 1043 of the sole structure 1004. The ends of the straps 1024, 1034 may include a head portion (not shown) to prevent the ends of the straps 1024, 1034 from decoupling with the sole structure 1004. The head portion may resemble a know or a radial disc that includes a larger diameter than the plurality of apertures 1042. In some embodiments, the head portion can be disposed within the sole structure. For example, the head portion can be disposed between the outsole 1006 and the midsole 1008 of the sole structure 1004 to prevent exposure of the head portion along the scrubbing surface.

Additionally, and alternatively, referring to FIG. 28, the sole structure 1004 may include straps 1022 to provide support about the heel of the foot. In the illustrated example, a heel strap or third strap 1044 includes a first end 1046 and a second end 1048 that extends from the midfoot region 1018. More specifically, the first end 1046 is fixated about the medial side 1014 and the heel strap 1044 extends arcuately around the heel region 1020 of the sole structure 1004 toward the lateral side 1012 of the midfoot region 1018 where the second end 1048 is fixated. In some embodiments, the first end 1046 of the heel strap 1044 can be coupled adjacently through the same aperture 1042 that receives the second end 1028 of the first strap 1024 and the second end 1048 of the heel strap 1044 can be coupled adjacently through the same aperture 1042 that receives the second end 1038 of the second strap 1034.

Referring to FIG. 29, similar to the cleaning sock 700 illustrated in FIG. 25, the outsole 1006 of the sole structure 1004 includes a sole cavity 1050. The sole cavity 1050 may extend along a sole width W between the medial side 1014 and the lateral side 1012 of the foot with an opening 1052 directed toward the medial side 1014 of the sole structure 1004. For example, the sole cavity 1050 may extend along the entire sole width W or may extend partially along the sole width W of the sole structure 1004. Alternatively, the opening 1052 can be directed to the lateral side 1012 of the sole structure 1004. The sole cavity 1050 may extend between a sole length L between the forefoot region 1016 and the heel region 1020 of the sole structure 1004. For example, the sole cavity 1050 may extend along the entire sole length L or may extend partially along the sole length L of the sole structure 1004. The sole cavity 1050 defines an abrasive pocket 1054 similar to the abrasive pocket 902 of FIG. 25. For example, in the illustrated embodiment, the opening 1052 of the abrasive pocket 1054 extends along the sole length L between the forefoot region 1016 and the midfoot region 1018 of the outsole 1006.

Additionally and alternatively, the abrasive pocket 1054 may extend between the first and second straps 1024, 1034 to partially cover the head portion (not shown) disposed at the ends of the first and second straps. For instance, exposure of the head portion while scrubbing may cause the straps to decouple from the sole structure 1004. The abrasive pocket 1054 provides a layer of protection which may provide preventive measures as to the straps 1024, 1034 being decoupled from the sole structure. In some embodiments, the abrasive pocket 1054 may also cover the third strap 1044 to provide similar benefits as discussed above.

The abrasive pocket 1054 provides similar functions and benefits as the abrasive pocket 902 of FIG. 25 of the cleaning socks. For example, the abrasive pocket 1054 may be used to enclose a cleaner or a cleaning agent that may be inserted into the abrasive pocket 1054 between an inner abrasive layer 1056 and an outer abrasive layer 1058. The friction between the inner abrasive layer 1056 and the outer abrasive layer 1058 can dissolve the cleaner or the cleaning agent (e.g., essential oils) and permeate the cleaner to the outer abrasive layer 1058 of the sole cavity 1050. In some examples, the inner abrasive layer 1056 can be formed integrally with the sole structure 1004. For example, the inner abrasive layer can be formed integrally with the outsole 1006 of the sole structure 1004. As described above, the inner abrasive layer may prevent the ends of the straps from decoupling with the sole structure by providing a layer of protection to the head portion disposed at the ends of the straps. In some embodiments, the outer abrasive layer 1058 may include an absorbent cloth the hold the cleaner. In some embodiments, as described above, the outer abrasive layer 1058 may include a webbed structure to provide additional traction when both cleaning sandals are worn in order to prevent slip hazard of the user. In some embodiments, cleaning strips (not shown) can be added along the edge of the sole structure 1004 to provide additional friction for heavier scrubbing. For instance, having cleaning strips along the sole structure 1004 may allow the cleaning sandal 1000 to access grouts or hard to access areas.

The foot wearable cleaning device may be configured as a cleaning shoe similar to the cleaning socks 700 illustrated in FIG. 19. However, the cleaning shoe may include a single compartment that encloses all of the toes together. The shoe may include a sole cavity similar to the sole cavity 1050 illustrated in FIG. 29 of the cleaning sandal 1000. Additionally, different types of textures can be applied about an upper of the cleaning shoe. The upper of the cleaning shoe is equivalent to the dorsal surface of the sock that extends from the sole structure to cover the instep of the foot (e.g., opposite of the outsole). In some embodiments, the cleaning shoe may include cleaning strips disposed along the upper of the cleaning shoe or the edge of the sole structure.

As described above, in some embodiments, the foot wearable cleaning device may include additional features along a bottom surface (e.g., outsole or the surface that makes contact with a ground surface) to increase traction. The additional features can be a strip or a pad that extend along the bottom surface. More specifically, elastomeric material such as latex or rubber can be attached to the bottom surface of the foot wearable cleaning device. For example, referring to FIG. 19, a strip 1080 can be a crescent shape strip that is attached along the heel or a ball of the foot. Alternatively, circular pads can be glued onto the bottom surface of the foot wearable cleaning device.

The cleaning devices of the present disclosure may be manufactured from interweaving or interknitting synthetic fibers, natural fibers, and/or microfibers. In some embodiments, the cleaning devices may be formed by intertwining materials with different properties such as thickness, the density, the color and/or the tear strength. To that extent, different patterns can be woven or knitted to form the cleaning devices of the present disclosure. For example, a first material formed from nylon can be intertwined to with a second material formed from a sustainable material. Alternatively, different textiles can be coupled via sewing or knitting to form the cleaning device. For example, the pre-made textile can be coupled together to form the cleaning device. In some examples, adhesives or buttons can be used to couple different textiles together to form the cleaning device. For instance, the cleaning strips of the cleaning gloves 100 may include attachment features (e.g., grooves and slot) to replace the cleaning strips to a bristle or a scrubbing tube with a different magnitude of abrasion.

When a harder material comes into contact with a softer material, the harder material will cause the softer material to be worn away via friction. This is commonly described as abrasion. The magnitude of abrasion can be identified by measuring the process of wearing of a material induced by friction. Conventionally, Taber Abrasion Test, which follows ASTM Standard D4060 can be used to evaluate and measure the magnitude of abrasion of a material. Alternatively, the magnitude of abrasion can be identified visually by the appearance of texture of the material. For example, the texture may be visually rough including uneven sharp surfaces and the texture may be visually smooth including rounded surfaces without protrusions. Heavier or greater abrasive material removes more material than a lighter or less abrasive material. For example, the greater abrasive material would provide user's skin with a harder and rougher texture to exfoliate more dead cells of the user's skin whereas the less abrasive material would provide smoother texture than the greater abrasive material and provide less exfoliation. To that extent, user's (e.g., children) with sensitive skin may use less abrasive material for exfoliation.

As mentioned above, the process of cleaning hard surfaces comprises a process of applying a cleaning agent or detergent across a cleaning area. Once applied, the cleaning area is scrubbed using the cleaning glove 100. The configuration of the skeletal anatomy of the body 108 provides benefits that may not be obtainable from advanced mechanical cleaning tools. The synchronization between a human eye as providing the input, and the body 108 as delivering the output, the force exerted during the scrubbing process can be adjusted based on the location. For instance, the shape of mechanical tools (e.g., plastic edges encasing a scrubber) may limit the mechanical tools from reaching narrow or hard to reach areas. For example, a handle of a bathroom scrubber may prohibit the bathroom scrubber from accessing the corners of the bathtub or a narrow channel within the bathtub. The cleaning glove 100 worn over the body 108 can be oriented in different angles to access the areas that would be inaccessible by some physical and mechanical tools. Referring back to FIG. 1, the cleaning strip 530 is formed integrally with the outer periphery 504 of the cleaning glove 100 that is disposed along the traverse plane TP of the inner edge 356 of the body 108 and along the outer fourchette 164 of the little finger 136. The cleaning strip 530 may include the plurality of bristles 540 or the tubular structure 542 including the abrasive outer surface 544. The cleaning strip 530 may be used to clean the grout by moving the cleaning strip along a channel of the grout.

The thumb 120 with three degree of freedom and the wrist 116 providing additional three degree of freedom allows the abrasive pad 152 defined within the thumb 120 of the cleaning glove to provide versatility during cleaning and exfoliating. The multiple degrees of freedom of the thumb 120 allows the cleaning glove 100 to reach hard-to-approach areas. The wrist joint 362, the distal interphalangeal joint 260, the proximal interphalangeal joint 262, and the metacarpophalangeal joint 264 in combination provides multiple degrees of freedom, allowing the body 108 to provide different motion such as extension, flexion, abduction, and adduction. Different motions of the body 108 may be transferred to the cleaning glove 100 for exfoliation and cleaning of the bathtub. For example, the repeated motion of adduction and abduction about the proximal interphalangeal joint 262 (e.g., wrist joint) may providing a scrubbing motion.

Unlike the hand discussed above, the motion of the foot 726 is restricted by the motion derived by the ankle joint 840. Referring back to FIG. 26, the ankle joint 840 is configured to provide an eversion 920 of the foot 726, an inversion 922 of the foot 726, a dorsiflexion 924 of the foot 726, and a plantarflexion 926 of the foot 726. Conventionally, the foot 726 may be normal to the ground plane GP, where the abrasive pocket 902 may be used to scrub the flat surface of the bathroom floor. The curved surfaces and edges may be cleaned by performing the motion of eversion 920 of the foot 726 and the inversion 922 of the foot 726. The eversion 920 of the foot 726 and the inversion 922 of the foot 726 occurs along a longitudinal axis L1, located along the midline ML of the foot 726. The eversion 920 of the foot 726 is a rotational motion toward the lateral side 848 of the foot 726 and the inversion 922 of the foot 726 is a rotational motion toward the medial side 846 of the foot 726. The lateral side 848 of the foot 726 and the medial side 846 of the foot 726 can access the curved surfaces and the edges of the bathtub easier than the sole portion 712 of the cleaning socks 700.

The dorsiflexion 924 of the foot 726 and the plantarflexion 926 of the foot 726 may be used to clean the walls of the bathtub. The dorsiflexion 924 of the foot 726 and the plantarflexion 926 of the foot 726 occurs along a lateral axis L2. The lateral axis L2 and the longitudinal axis L1 defines the ground plane GP and the vertical axis V extends perpendicular to the ground plane GP. The dorsiflexion 924 of the foot 726 and the plantarflexion 926 of the foot 726 allows the foot 726 to move up and down about the lateral axis L2. The toe portion 716 of the cleaning sock 700 may be used to clean the bathtub walls through the repeated motion of dorsiflexion 924 of the foot 726 and the plantarflexion 926 of the foot 726.

In some embodiments, a hand wearable cleaning device may include alternative features. More specifically, the configuration of the abrasive pads can extend in different shapes along the palmar surface of the hand. In some examples, the abrasive pads may include different texture or intensity of abrasion from each other. In some examples, the materials comprising the abrasive pads can be different.

Figure 30:
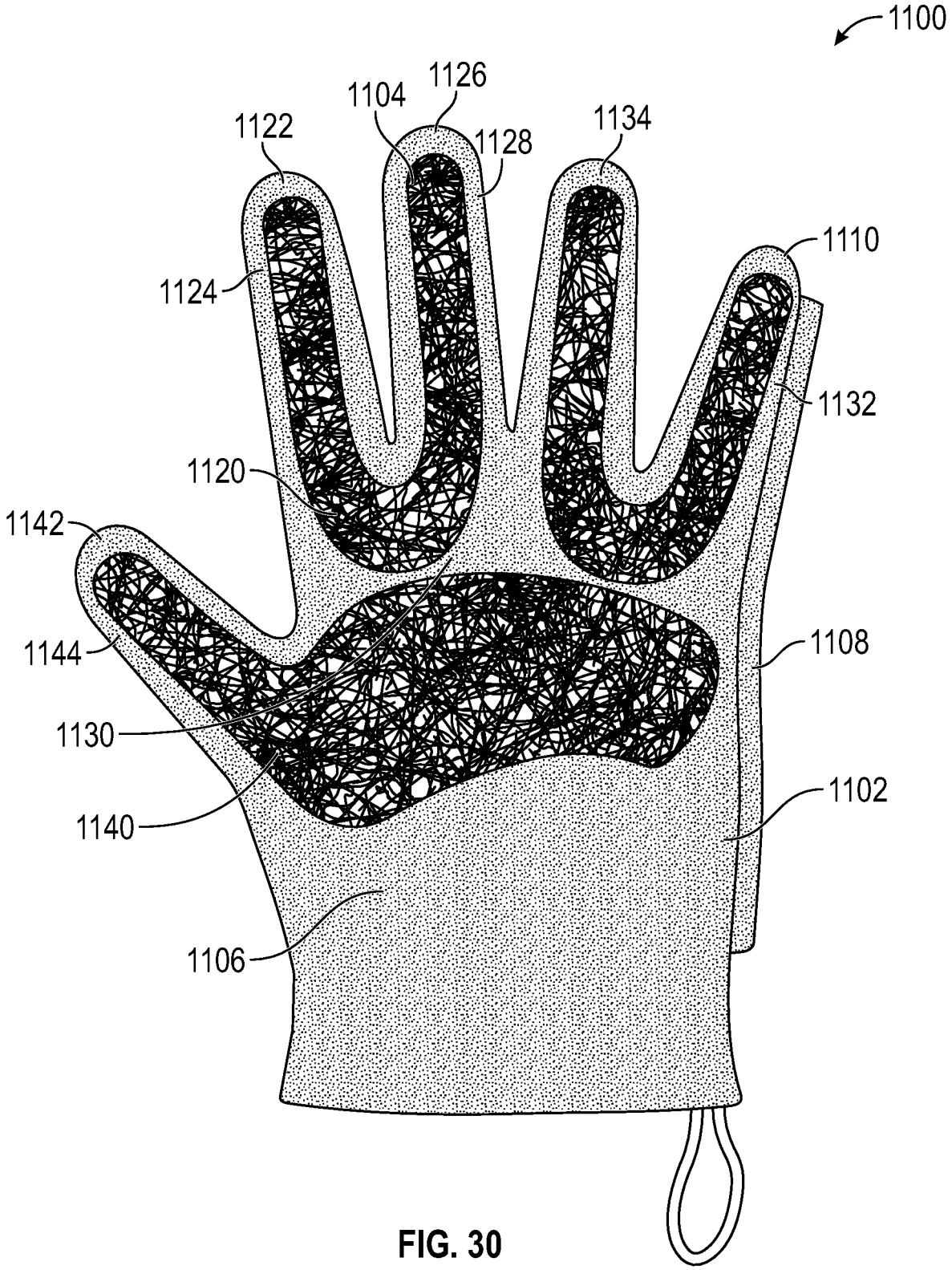
FIG. 30 is a perspective view of another hand wearable cleaning device in accordance with the present disclosure.

With reference to FIG. 30, a first example hand wearable cleaning device 1100 in a form of a cleaning glove includes an example body 1102. The example body 1102 includes abrasive pads 1104 that are connected to a palmar surface 1106 and a cleaning strip 1108 that disposed along a fourchette of a little finger 1110 between the palmar surface 1106 and the dorsal surface (not shown) of the body 1102.

In the illustrated embodiment, the abrasive pads 1104 extend from between two distal ends (e.g., distal interphalangeal) of two fingers. For example, a first abrasive pad 1120 extend from a distal end 1122 of an index finger 1124 to a distal end 1126 of the middle finger 1128 and between a ball 1130 of the neighboring fingers. In other words, the first abrasive pad 1120 may be U-shaped. Similar arrangements can be made to a second abrasive pad 1132 between a ring finger 1134 and the little finger 1110 Alternatively, the abrasive pad 1104 can extend between distal ends of three fingers and can be W-shaped. In addition, a third abrasive pad 1140 can extend between a distal end 1142 of a thumb 1144 and along the ball 1130 of the hand. In other words, the third abrasive pad 1140 can extend laterally along the ball of the hand toward the distal end 1142 of the thumb 1144.

Figure 31:
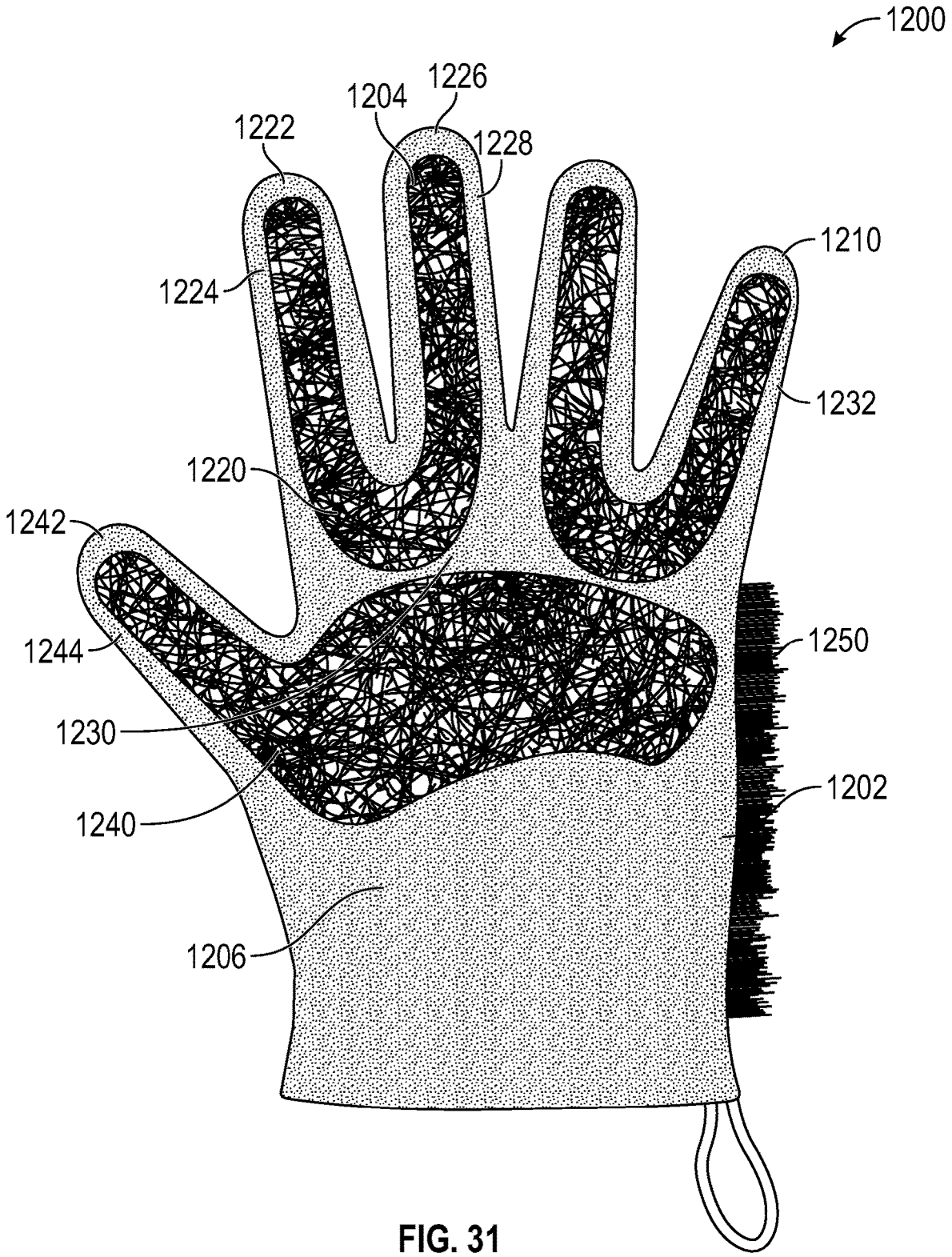
FIG. 31 is a perspective view of still another hand wearable cleaning device in accordance with the present disclosure.

With reference to FIG. 31, a second example hand wearable cleaning device 1200 in a form of a cleaning glove includes an example body 1202. The second example hand wearable cleaning glove includes similar features as discussed above in FIG. 30 and similar reference numbers are used to indicate similar features. The second example hand wearable cleaning device 1200 includes a bristle 1250 that extends along a fourchette of a little finger 1220.

Figure 32:
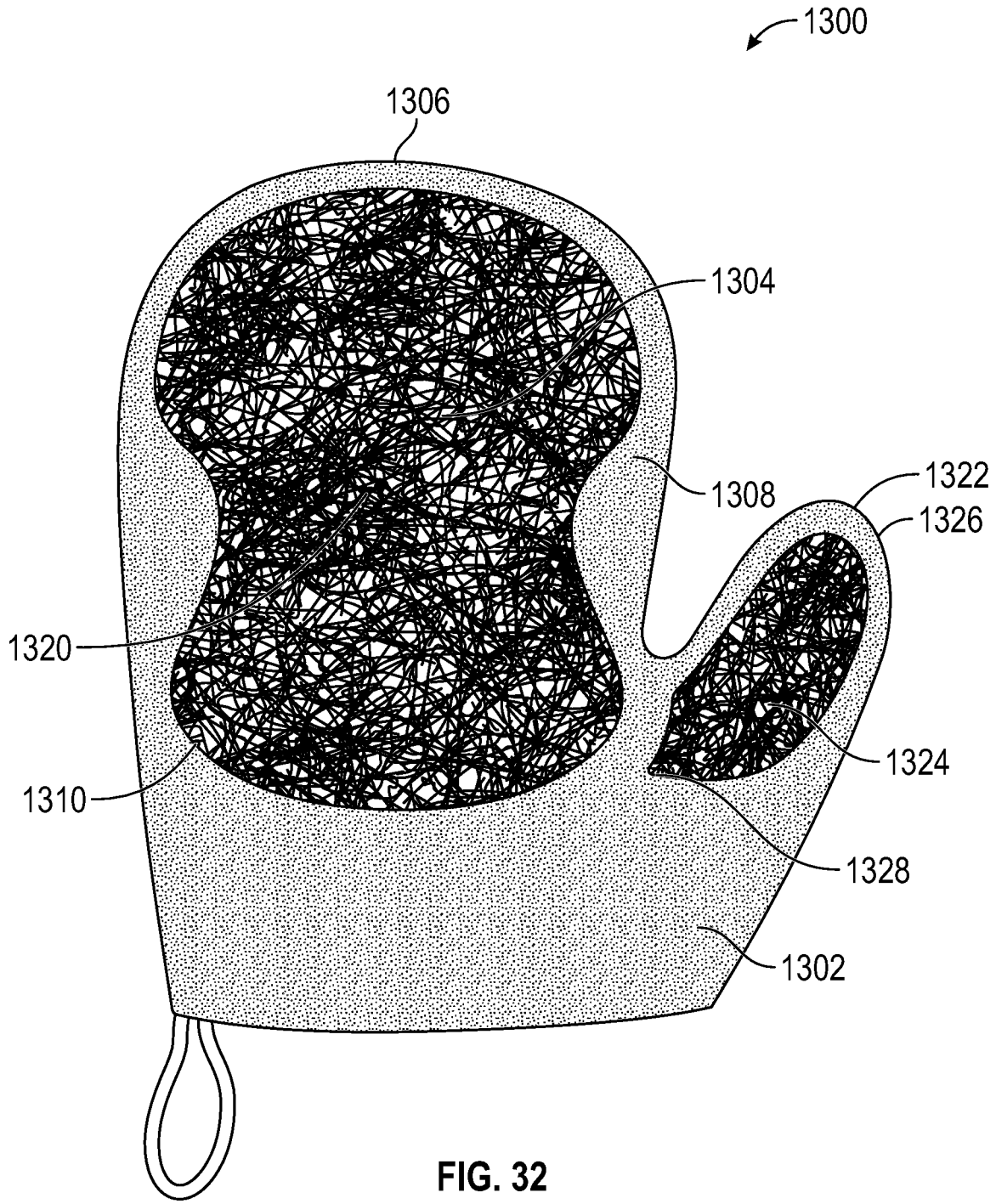
FIG. 32 is a perspective view of a yet another hand wearable cleaning device in accordance with the present disclosure.

With reference to FIG. 32, a third example hand wearable cleaning device 1300 in a form of a cleaning mitten includes an example body 1302. The example body includes abrasive pads 1304 that extends between distal ends 1306 of the fingers 1308 and a ball 1310 of the hand. In some embodiments, the fingers may form a first pad 1320 and a thumb 1322 may form a second pad 1324. In the illustrated example, the first pad 1320 extends between the distal end 1306 of the fingers 1308 and the ball 1310, and the second pad 1324 extends between a distal end 1326 of the thumb 1322 and a ball 1328 of the thumb 1322.

In some embodiments, a foot wearable cleaning device may include alternative features. More specifically, the configuration of the abrasive pads can extend in different shapes along an outsole or insole of the foot wearable cleaning device. In some examples, the abrasive pads may include different texture or intensity of abrasion from each other. In some examples, the materials comprising the abrasive pads can be different.

Figure 33:
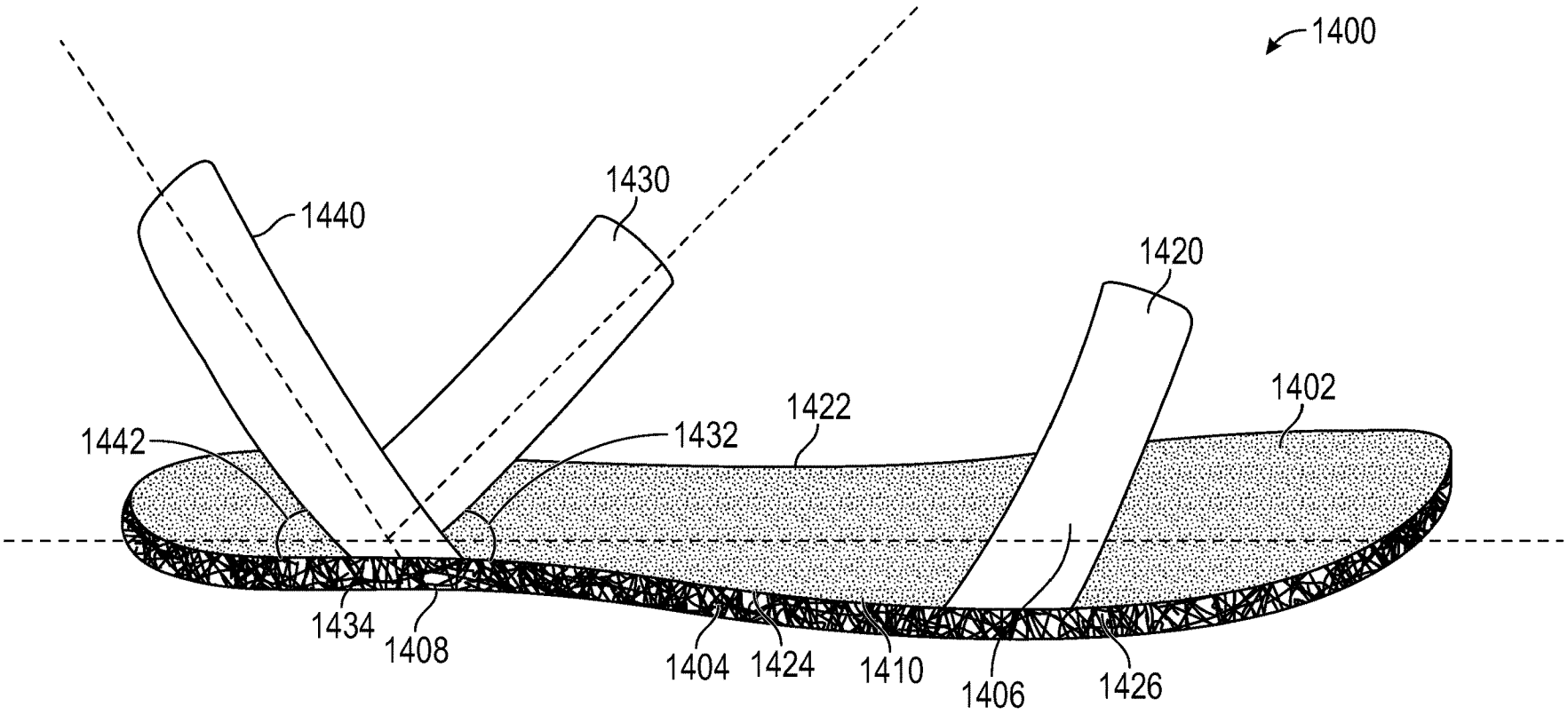
FIG. 33 is a perspective view of another foot wearable cleaning device in accordance with the present disclosure.

With reference to FIG. 33, a first example foot wearable cleaning device 1400 includes a body 1402. The body 1402 includes a sole structure 1404 and a plurality of straps 1406. The sole structure 1404 includes an outsole 1408 and an insole 1410 that is opposite of the outsole. In some embodiments, a midsole (not shown) can be disposed between the outsole 1408 and the insole 1410. The plurality of straps 1406 can extend between two ends of the sole structure 1404 to provide securement with the foot of the user. In the illustrated embodiment, a first strap 1420 extends between a medial side 1422 of the foot and a lateral side 1424 of the foot along a forefoot region 1426. A second strap 1430 extends between the medial side 1422 of the foot and the lateral side 1424 of the foot at a first angle 1432 about a heel region 1434. The first angle 1432 is defined between the second strap 1430 relative to the insole of the body 1402. For example, the second strap extends toward the forefoot region 1426 of the foot and wraps around an ankle (not shown) of the user. A third strap 1440 extends between the medial side 1422 of the foot and the lateral side 1424 of the foot at a second angle 1442 about a heel region 1434. The second angle 1442 is defined between the third strap 1440 relative to the insole of the body 1402. For example, the third strap 1440 extends toward the heel region 1434 of the foot and wraps around a heel (e.g., Achilles tendon) of the user. In some embodiments, the outsole 1408 may include a pocket (not shown) to retain a cleaner or essential oil.

Any of the embodiments described herein may be modified to include any of the structures or methodologies disclosed in connection with different embodiments. Further, the present disclosure is not limited to wearable cleaning devices of the type specifically shown. Still further, aspects of the wearable cleaning devices of any of the embodiments disclosed herein may be modified.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

I claim:

1. A foot wearable cleaning device comprising:

a body including a sole;

a sole cavity disposed along a bottom surface of the sole, the sole cavity including an opening, the opening defining an abrasive pocket with an inner abrasive layer and an outer abrasive layer; and an abrasive pad coupled to the bottom surface of the sole;

wherein the abrasive pocket encloses a cleaner, and wherein the abrasive pocket is not coupled along at least one side of the foot wearable cleaning device to form the opening.

2. The foot wearable cleaning device of claim 1, wherein the foot wearable cleaning device includes a dorsal surface that is coupled with the sole to define an interior volume of the body, and wherein the sole includes a first material and the dorsal surface includes a second material, the first material and the second material being identical.

3. The foot wearable cleaning device of claim 2, wherein the first material of the sole and the second material of the dorsal surface are an exfoliating material.

4. The foot wearable cleaning device of claim 2, wherein the abrasive pad includes a third material, and wherein the third material is different from the first material and the second material.

5. The foot wearable cleaning device of claim 4, wherein the third material is more abrasive than the first material and the second material.

6. The foot wearable cleaning device of claim 2, wherein the abrasive pad is coupled individually to each toe within a toe portion.

7. The foot wearable cleaning device of claim 1, wherein the foot wearable cleaning device includes a plurality of straps extending between two parts of the sole, and wherein at least one of the plurality of straps forms a toe post.

8. The foot wearable cleaning device of claim 7, wherein the foot wearable cleaning device includes a heel strap.

9. The foot wearable cleaning device of claim 7, wherein the plurality of straps is inserted through a plurality of apertures disposed perpendicular to the bottom surface of the sole, and wherein each of the plurality of straps include a head portion disposed about an end of the plurality of straps.

10. The foot wearable cleaning device of claim 1, wherein the body further includes a cuff portion and a leg portion, and wherein the cuff portion defines an aperture of the interior volume of the body.

11. The foot wearable cleaning device of claim 10, wherein the cuff portion includes a hanging loop configurated to hang the cleaning device.

12. The foot wearable cleaning device of claim 1, wherein the inner abrasive layer is fully affixed to the sole.

13. The foot wearable cleaning device of claim 1, wherein a rubber strip is attached along a bottom surface and extends along a ball of the foot.

14. The foot wearable cleaning device of claim 13, wherein the rubber strip has a crescent shape and is configured to increase traction on the bottom surface.

15. The foot wearable cleaning device of claim 13, wherein the rubber strip is disposed between the abrasive pocket and the abrasive pad.

16. The foot wearable cleaning device of claim 13, wherein the rubber strip defines a toe end of the outer abrasive layer.

* * * * *